US011247115B2

(12) United States Patent
Blecher

(10) Patent No.: US 11,247,115 B2
(45) Date of Patent: Feb. 15, 2022

(54) FLUID-BASED EXOSKELETAL BODY ARMOR WITH CLIMATE CONTROL

(71) Applicant: Sports Medicine Sciences, LLC, Encino, CA (US)

(72) Inventor: Andrew Blecher, Encino, CA (US)

(73) Assignee: Sports Medicine Sciences, LLC, Encino, CA (US)

( * ) Notice: Subject to any disclaimer, the term of this patent is extended or adjusted under 35 U.S.C. 154(b) by 525 days.

(21) Appl. No.: 15/292,354

(22) Filed: Oct. 13, 2016

(65) Prior Publication Data

US 2017/0100659 A1 Apr. 13, 2017

Related U.S. Application Data

(60) Provisional application No. 62/240,613, filed on Oct. 13, 2015.

(51) Int. Cl.

| | |
|---|---|
| ***A63B 71/08*** | (2006.01) |
| ***A42B 3/22*** | (2006.01) |
| ***A42B 3/04*** | (2006.01) |
| ***A41D 13/05*** | (2006.01) |
| ***A41D 13/005*** | (2006.01) |
| ***A63B 71/10*** | (2006.01) |
| ***A63B 71/12*** | (2006.01) |
| ***F41H 1/02*** | (2006.01) |
| ***F41H 1/04*** | (2006.01) |

(52) U.S. Cl.

CPC ..... *A63B 71/081* (2013.01); *A41D 13/005* (2013.01); *A41D 13/0512* (2013.01); *A41D 13/0518* (2013.01); *A42B 3/046* (2013.01); *A42B 3/0473* (2013.01); *A42B 3/225* (2013.01); *A63B 71/10* (2013.01); *A63B 71/1291* (2013.01); *F41H 1/02* (2013.01); *F41H 1/04* (2013.01); *A63B 2071/1208* (2013.01)

(58) Field of Classification Search

CPC ... A63B 71/081; A63B 71/10; A63B 71/1291; A63B 2071/1208; A41D 13/005; A41D 13/0518; A41D 13/0512; A42B 3/046; A42B 3/225; A42B 3/0473; A42B 3/205; A42B 3/00; A42B 3/94; A42B 3/96; A42B 3/08; A42B 3/10; A42B 3/12; F41H 1/04; F41H 1/02

USPC ..... 2/463, 464, 467, 411, 413, 468

See application file for complete search history.

(56) References Cited

U.S. PATENT DOCUMENTS

| | | | | | |
|---|---|---|---|---|---|
| 3,774,239 | A * | 11/1973 | Kotzar | A42B 3/221 | 2/10 |
| 4,783,853 | A * | 11/1988 | Zuber | A41D 13/015 | 2/2.5 |
| 2006/0144557 | A1* | 7/2006 | Koscheyev | A41D 13/005 | 165/46 |
| 2007/0085340 | A1* | 4/2007 | Gammons | F16L 37/0841 | 285/308 |

(Continued)

*Primary Examiner* — Jocelyn Bravo

(74) *Attorney, Agent, or Firm* — Pandiscio & Pandiscio

(57) ABSTRACT

A protective system including: a protective suit capable of withstanding the force of an impact without tearing, the protective suit including: a head portion; a neck portion connected to the head portion; a torso portion connected to the neck portion; a fluid bladder formed in at least two of the head portion, neck portion and torso portion, the fluid bladder containing a fluid; and an alert indicator for indicating when the force of an impact on the fluid bladder exceeds a predetermined threshold.

39 Claims, 24 Drawing Sheets

(56) References Cited

U.S. PATENT DOCUMENTS

| | | | | |
|---|---|---|---|---|
| 2008/0307569 | A1* | 12/2008 | Roberts | A41B 9/00 2/456 |
| 2010/0251451 | A1* | 10/2010 | Feldman | F41H 1/02 2/2.5 |
| 2012/0214647 | A1* | 8/2012 | Ji | A63B 69/004 482/8 |
| 2013/0283506 | A1* | 10/2013 | Archbold | A42B 3/121 2/413 |
| 2013/0298318 | A1* | 11/2013 | Rogers | A42B 3/185 2/439 |
| 2014/0007326 | A1* | 1/2014 | Nelson | A42B 3/121 2/413 |
| 2015/0230534 | A1* | 8/2015 | McGuckin, Jr. | A42B 3/128 2/411 |
| 2015/0320134 | A1* | 11/2015 | Stalker | A63B 71/10 2/411 |

* cited by examiner

FLUID-BASED EXOSKELETAL BODY ARMOR WITH CLIMATE CONTROL

REFERENCE TO PRIOR PATENT APPLICATION

This patent application claims benefit of prior U.S. Provisional Patent Application Ser. No. 62/240,613, filed Oct. 13, 2015 by Andrew Blecher for CONCUSSION REDUCTION SYSTEM COMPRISING NOVEL HELMET/FACEMASK AND NOVEL FLUID-BASED EXOSKELETON BODY ARMOR WITH CLIMATE CONTROL, which patent application is hereby incorporated herein by reference.

FIELD OF THE INVENTION

This invention relates generally to methods and apparatus for protecting the body, and more particularly to methods and apparatus for protecting the brain, neck and torso of a person against injury.

BACKGROUND OF THE INVENTION

There is growing awareness that injuries pose a serious health risk for athletes engaged in contact sports, e.g., football players. Of particular concern is the growing awareness of the health risk posed by concussive brain injuries. Among other things:

(1) current helmet/facemask constructions encourage helmet-to-helmet contact, have increased mass which increases head-to-neck mass ratios (which in turn increases the "bobble-head" effect, producing coup-counter-coup injuries to the brain), and have failed to reduce the incidence of concussions;

(2) current equipment does not adequately protect the neck of the athlete; and (3) current equipment does not adequately protect the torso of the athlete.

In addition, current equipment inhibits the body's ability to disperse body heat and leads to increased body core temperatures, which lowers athletic performance and risks heat-related illnesses (e.g., hyperthermia and heatstroke).

Similar problems exist in non-athletic situations, e.g., with military personnel, police personnel, etc. who are exposed to injuries such as from bomb blasts.

Thus there is a need for a new and improved system for protecting the body which provides better protection against concussions, provides better protection against neck injuries, provides better protection against torso injuries, and which protects against hyperthermia (and heatstroke) and hypothermia, and maximizes physical performance through optimization of body temperature.

SUMMARY OF THE INVENTION

These and other objects of the invention are addressed by the provision and use of novel fluid-based exoskeletal body armor with climate control. The novel body armor provides better protection against concussions, provides better protection against neck injuries, provides better protection against torso injuries, and protects against hyperthermia (and heatstroke) and hypothermia, and maximizes physical performance through optimization of body temperature.

In one preferred form of the invention, there is provided a protective system comprising:

a protective suit capable of withstanding the force of an impact without tearing, the protective suit comprising:

a head portion;

a neck portion connected to the head portion;

a torso portion connected to the neck portion;

a fluid bladder formed in at least two of the head portion, neck portion and torso portion, the fluid bladder containing a fluid; and an alert indicator for indicating when the force of an impact on the fluid bladder exceeds a predetermined threshold.

In another preferred form of the invention, there is provided a helmet comprising:

a head shell formed out of a light-weight composite and devoid of padding, the head shell comprising a crown-to-frontal wedge bossing;

a built-in soft gel eye socket mask; and an adjustable face shield and an adjustable chin protection for selectively covering the face of a wearer, wherein the face shield comprises wedge bossing.

In another preferred form of the invention, there is provided a method for protecting an individual, the method comprising:

positioning a protective system on the individual, the protective system comprising:

a protective suit capable of withstanding the force of an impact without tearing, the protective suit comprising:

a head portion;

a neck portion connected to the head portion;

a torso portion connected to the neck portion;

a fluid bladder formed in at least two of the head portion, neck portion and torso portion, the fluid bladder containing a fluid; and an alert indicator for indicating when the force of an impact on the fluid bladder exceeds a predetermined threshold.

BRIEF DESCRIPTION OF THE DRAWINGS

These and other objects and features of the present invention will be more fully disclosed or rendered obvious by the following detailed description of the preferred embodiments of the invention, which is to be considered together with the accompanying drawings wherein like numbers refer to like parts, and further wherein.

DETAILED DESCRIPTION OF THE PREFERRED EMBODIMENTS

The present invention comprises the provision and use of novel fluid-based exoskeletal body armor with climate control. The novel body armor provides better protection against concussions, provides better protection against neck injuries, provides better protection against torso injuries, and protects against hyperthermia (and heatstroke) and hypothermia, and maximizes physical performance through optimization of body temperature.

First Construction

Figure 1:
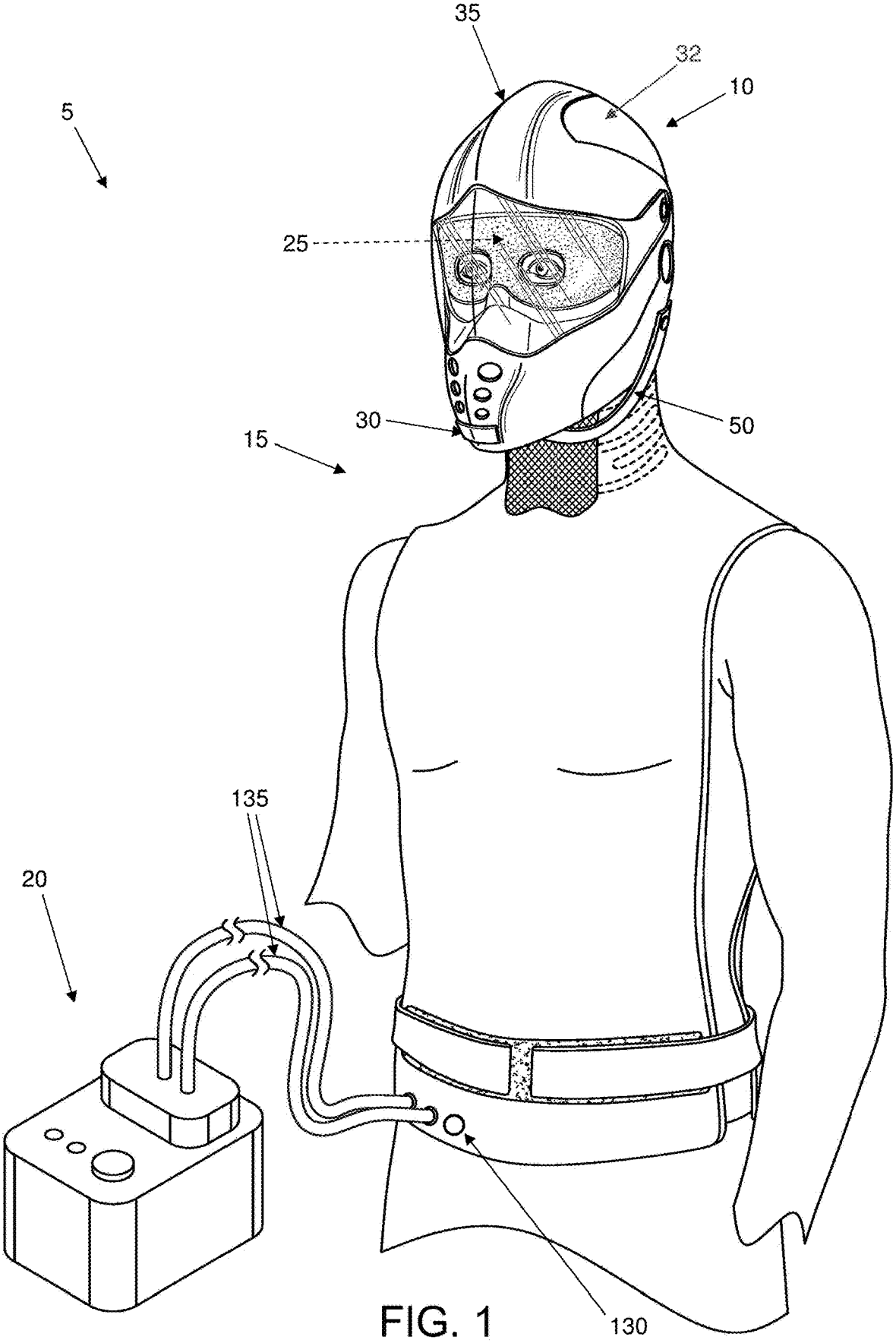
FIG. 1 is a schematic view showing a novel system formed in accordance with the present invention.
Figure 2:
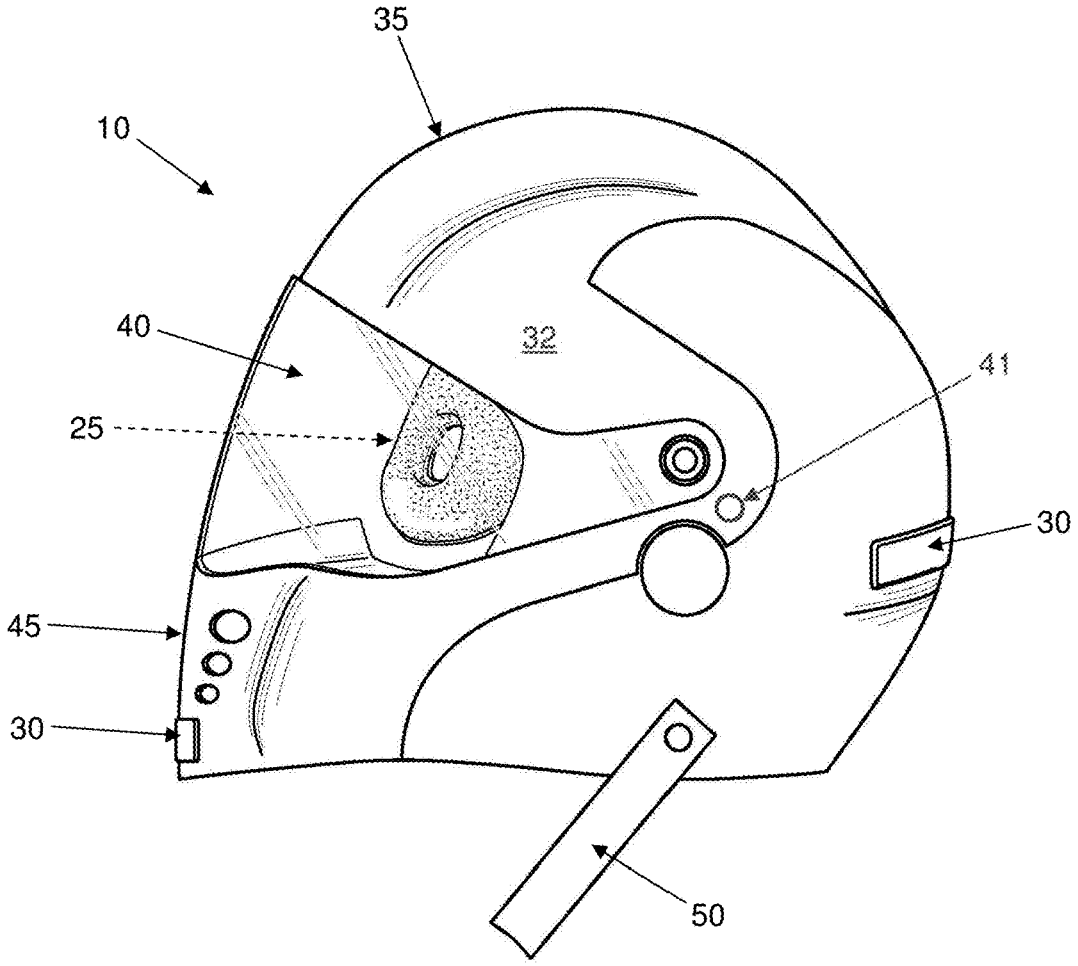
FIGS. 2-6 are schematic views showing a novel helmet formed in accordance with the present invention.
Figure 3:
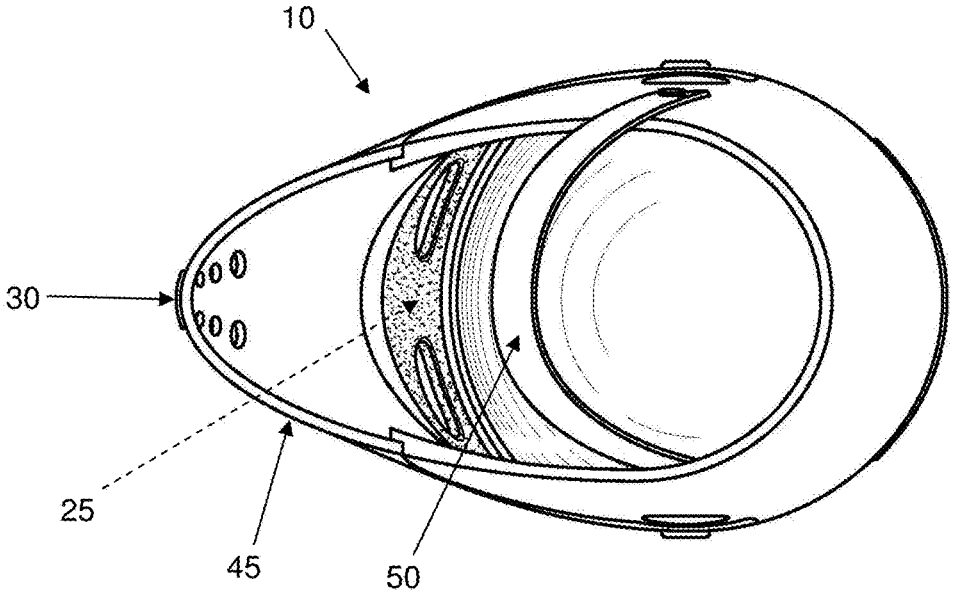
Figure 4:
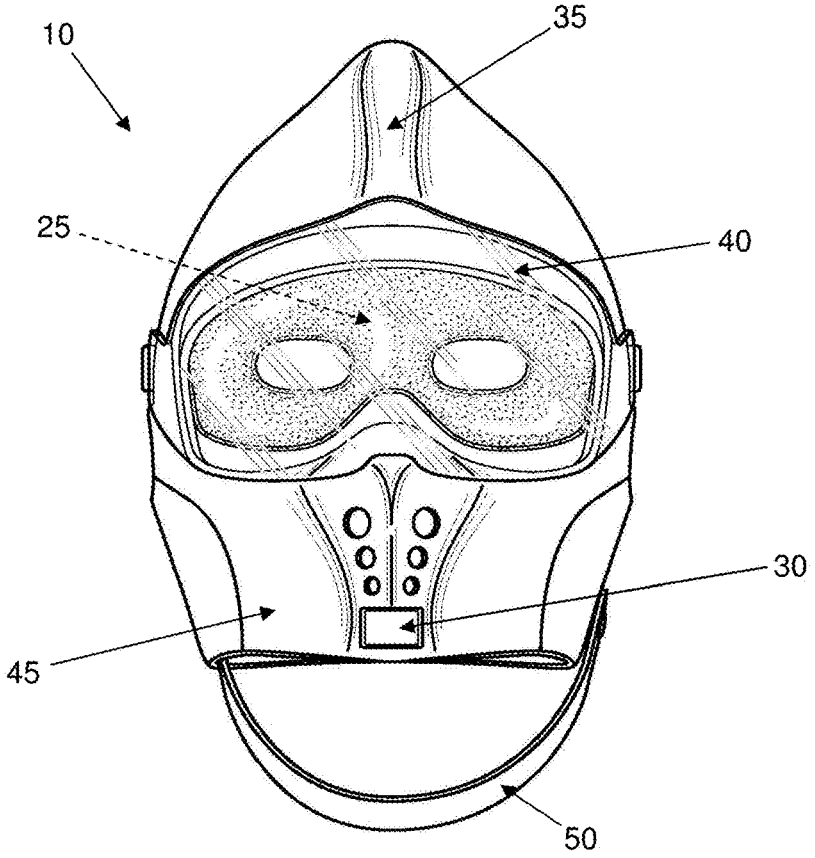
Figure 5:
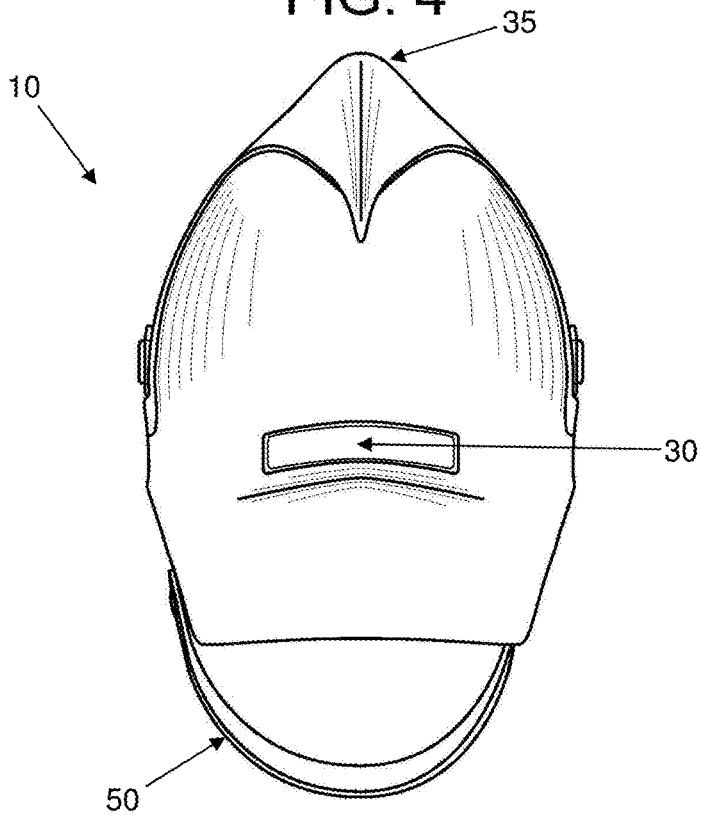
Figure 6:
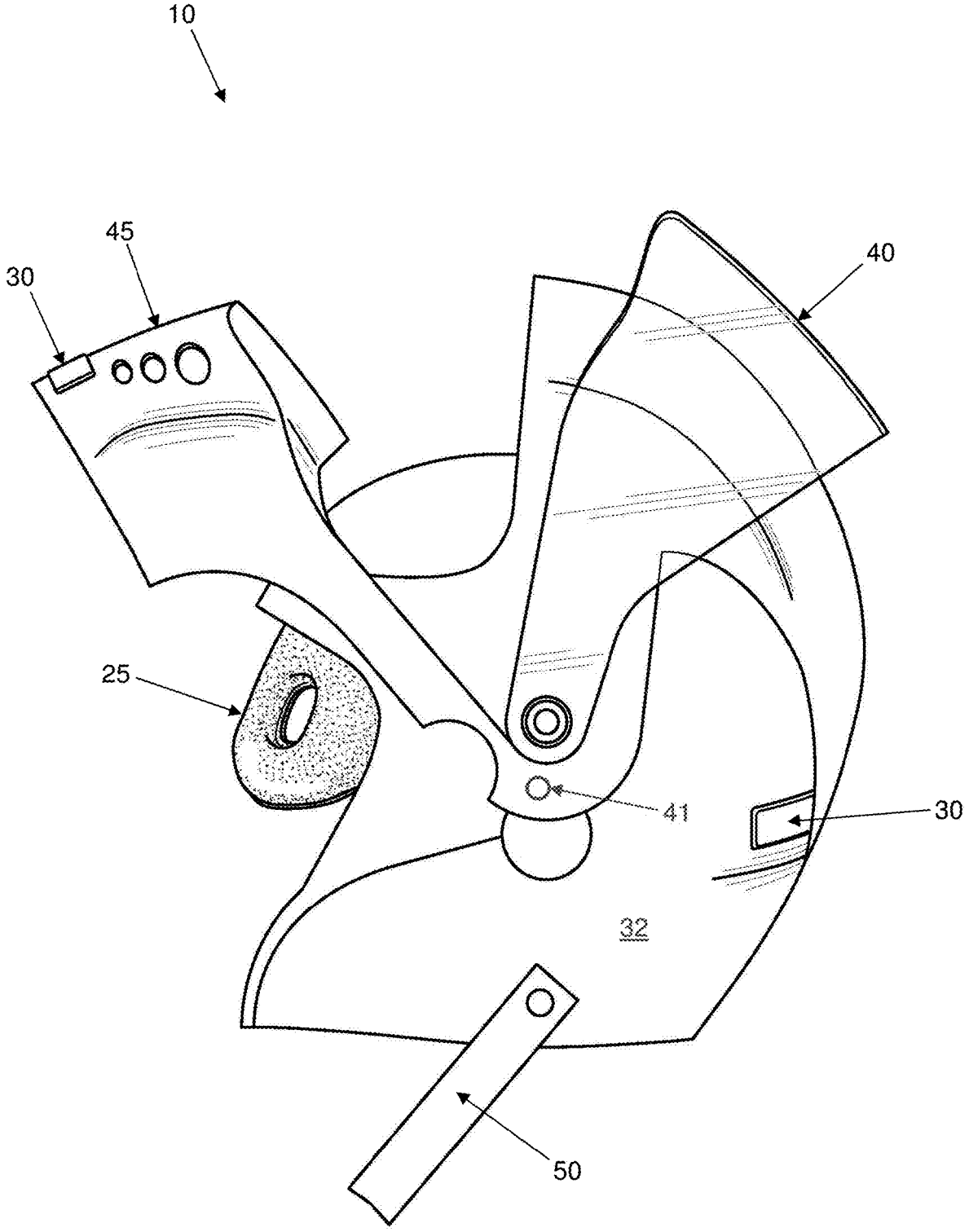
Figure 7:
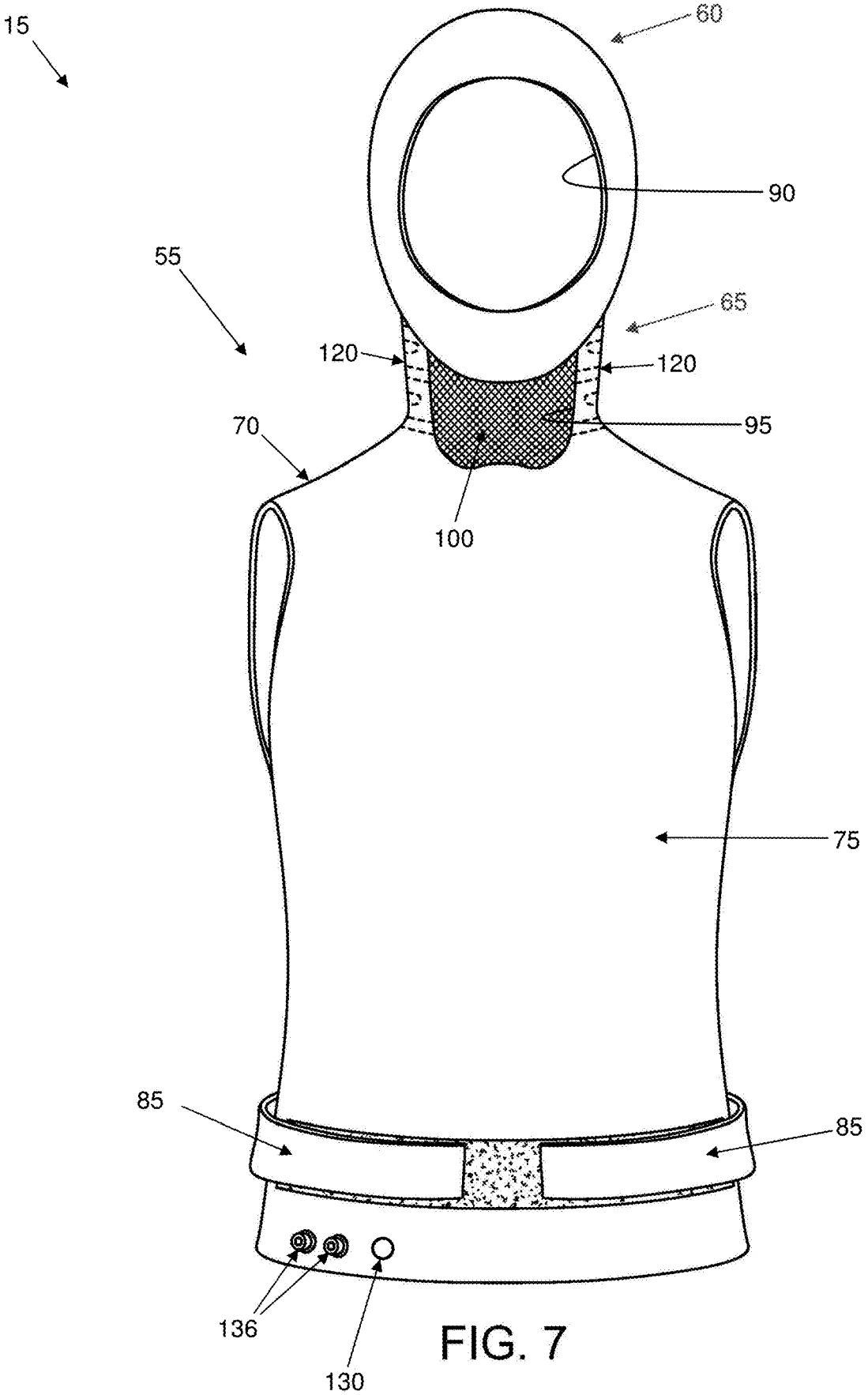
FIGS. 7-10 are schematic views showing a novel protective suit formed in accordance with the present invention.
Figure 8:
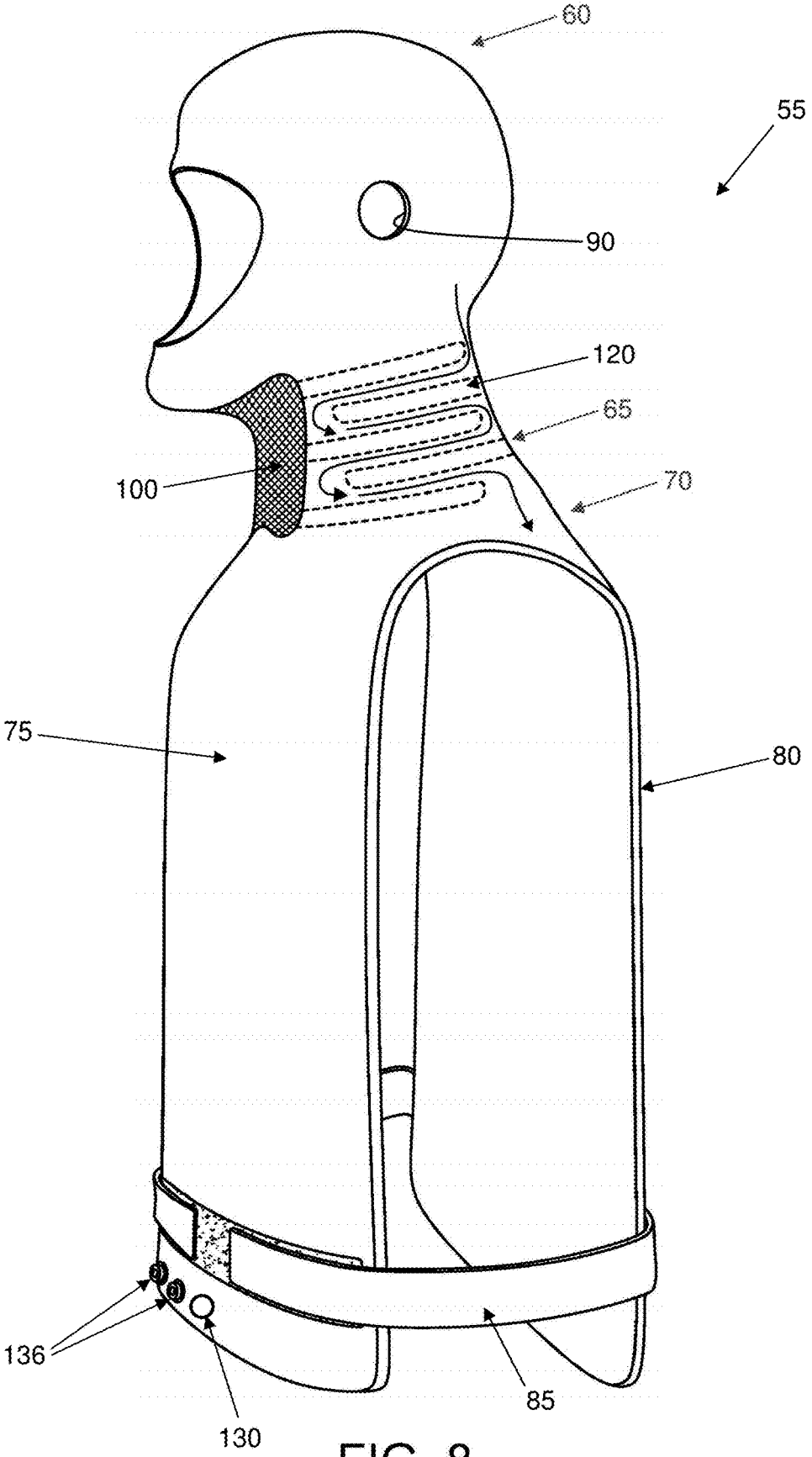
Figure 9:
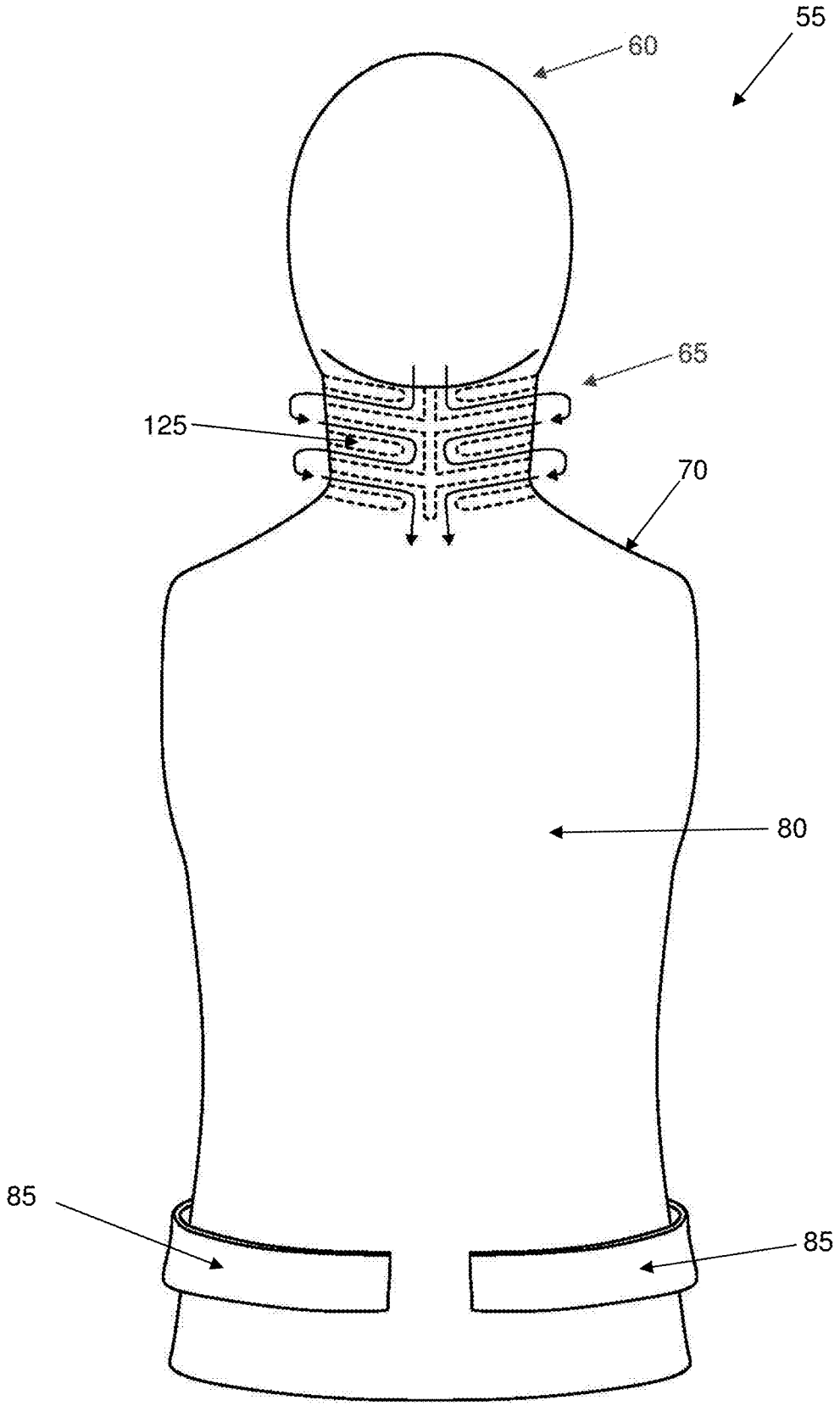

Looking first at FIG. 1, the present invention comprises the provision and use of a novel system 5 which provides fluid-based exoskeletal body armor with climate control. System 5 generally comprises (i) a novel helmet 10, and (ii) a novel protective suit 15. In addition, system 5 preferably comprises a temperature conditioning unit 20 which provides protective suit 15 with climate control so as to maintain physiologic body temperature and thereby maximize physical performance and prevent heat-related illnesses.

1. Novel Helmet 10

The present invention comprises a novel helmet 10 for minimizing head-on, helmet-to-helmet contact. Novel helmet 10 has decreased helmet weight (to reduce injury to others when the novel helmet 10 impacts another person, and to reduce fatigue of the user) and a decreased head-to-neck mass ratio (to reduce the "bobble-head" effect when the novel helmet 10 is impacted). In one preferred form of the invention, novel helmet 10 comprises a built-in, soft gel eye socket mask 25. Novel helmet 10 also includes at least one indicator light 30 to show when an impact force threshold has been exceeded (see below) and the user should be evaluated for concussion or other injury.

In one preferred form of the invention, and looking now at FIGS. 2-6, novel helmet 10 is preferably in the form of a motocross-style shell 32 with a crown-to-frontal wedge bossing 35 to eliminate head-on, helmet-to-helmet contact from the front or crown. Novel helmet 10 comprises the aforementioned built-in soft gel eye socket mask 25. The novel helmet 10 also includes a bossed face shield 40 and composite chin protection 45. A chin strap 50 is provided for keeping novel helmet 10 securely on the head of the user during physical activity. It should be appreciated that bossed face shield 40 and/or composite chin protection 45 are preferably configured so that the user can selectively pivot bossed face shield 40 and/or composite chin protection 45 upward relative to the remainder of novel helmet 10, whereby to selectively expose the user's face (see FIG. 6). To this end, a button 41 may be provided on helmet 10 which unlocks bossed face shield 40 and/or composite chin protection 45 when button 41 is depressed. It should be appreciated that when bossed face shield 40 and composite chin protection 45 are locked (i.e., button 41 has not been depressed), bossed face shield 40 and composite chin protection 45 do not pivot, even when an impact occurs to helmet 10 and/or bossed face shield 40 and/or composite chin protection 45. Being able to selectively pivot bossed face shield 40 and/or composite chin protection 45 upward relative to helmet 10 can be useful when the user is communicating with someone else (e.g., during a "huddle", etc.), or while the user is resting, or while the user is drinking, etc.

In one form of the present invention, novel helmet 10 has no padding on the inside of the helmet—the head portion of protective suit 15 (see below) provides protection for the head of the user, with soft gel eye socket mask 25 protecting the eyes of the user. Note that novel helmet 10 is streamlined so that substantially all blows to the helmet are "glancing blows".

2. Novel Protective Suit 15

Looking next at FIGS. 7-10, novel protective suit 15 is preferably in the form of a head/neck/chest/shoulder/back "suit" 55 with a built-in fluid system. More particularly, protective suit 15 comprises a head portion 60, a neck portion 65, a shoulder portion 70, a chest portion 75 and a back portion 80. Shoulder portion 70, chest portion 75 and back portion 80 are sometimes hereinafter referred to collectively as a "vest", with neck portion 65 and head portion 60 forming an integral extension of the vest (and thereby forming the complete protective suit 15). In one preferred form of the invention, the chest and back portions have a "short sleeve catcher protection shape" with Velcro closures 85 under the arms and on the sides of the torso.

Head portion 60 of protective suit 15 has cutouts 90 for the face and ears of the user. Neck portion 65 of protective suit 15 has a cutout 95 for the anterior neck of the user. The cutout 95 for neck portion 65 of protective suit 15 is preferably covered with an elastic mesh 100 to allow for easy pull-over of head portion 60 and neck portion 65 of protective suit 15 and also to enhance breathability for the user.

Head portion 60, neck portion 65, shoulder portion 70, chest portion 75 and back portion 80 together constitute protective suit 15. Head portion 60, neck portion 65, shoulder portion 70, chest portion 75 and back portion 80 together comprise a large single-cell bladder covering the head, neck, shoulders, chest and back of the user, and which is filled with a fluid (which may be pressurized) which acts as a large shock-absorber which absorbs the impact of a hard contact so as to provide protection to the user.

Figure 10:
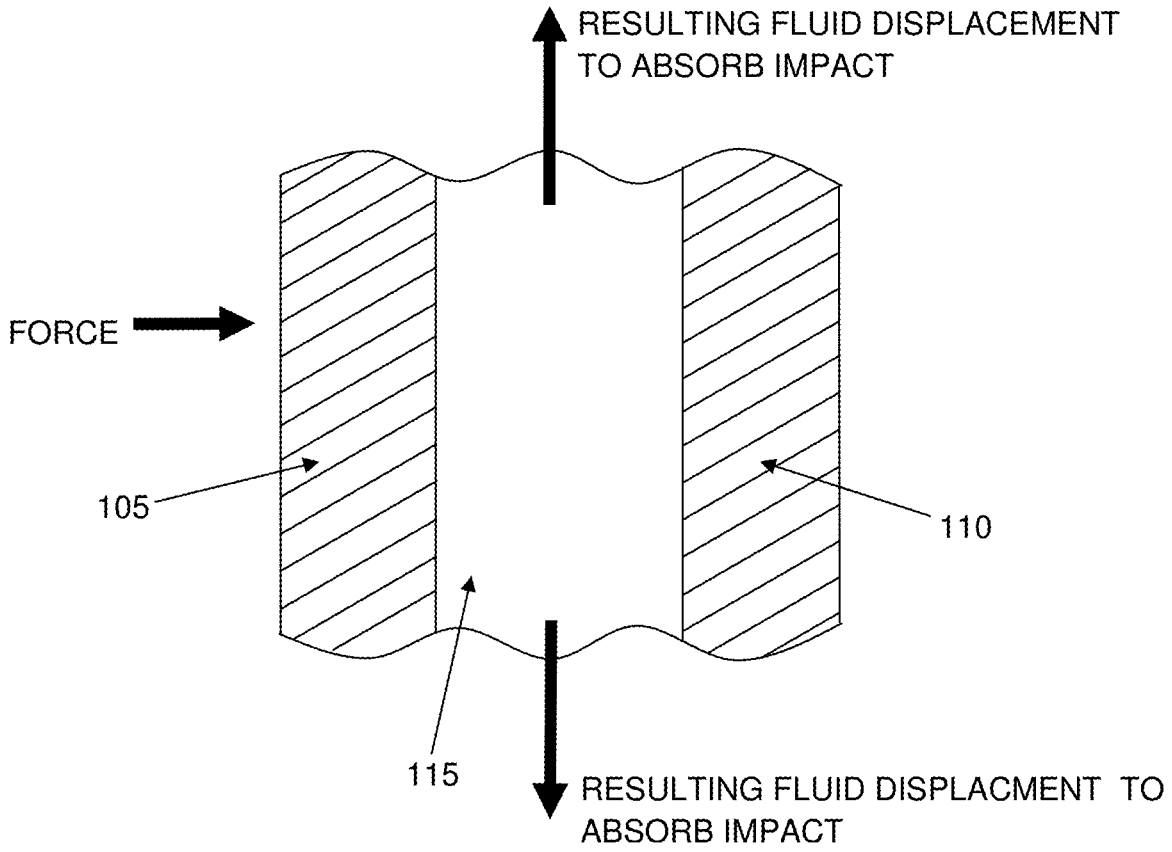

More particularly, in one form of the invention, and looking now at FIG. 10, protective suit 15 comprises an outer wall 105, an inner wall 110 and a fluid reservoir 115 disposed therebetween, with fluid reservoir 115 being filled with a fluid (e.g., a liquid, a combination of liquids, a gas, a combination of gases, a combination of liquids and gases, etc.). In one preferred form of the invention, fluid reservoir 115 is filled with water. Outer wall 105, inner wall 110, fluid reservoir 115 and the fluid therein cooperate with one another to essentially act as a shock-absorber to absorb the impact of a hard contact, whereby to provide protection to the user from a force imposed on outer wall 105 of protective suit 15.

It should be appreciated that outer wall 105 and inner wall 110 are formed out of a material or materials capable of withstanding the force of an impact without tearing and/or rupturing.

By way of example but not limitation, where the user receives an impact to their helmet 10, the fluid in head portion 60 of protective suit 15 is forced downwardly, into neck portion 65, shoulder portion 70, chest portion 75, and back portion 80. As the fluid in head portion 60 is forced downwardly, the force of the impact is absorbed by the transferring fluid and the head of the user is thereby protected. Note that the neck of the user and the torso of the user are also protected as fluid is forced into shoulder portion 70, chest portion 75 and back portion 80, thereby providing support for the anatomy of the user.

By way of further example but not limitation, where the user receives an impact to their torso, the fluid in chest portion 75 and/or back portion 80 is forced upwardly, into shoulder portion 70, neck portion 65 and head portion 60. As the fluid in chest portion 75 and/or back portion 80 is forced upwardly, the force of the impact is absorbed by the transferring fluid and the torso of the user is thereby protected. Note that the head of the user and the neck of the user are also protected as fluid is forced into neck portion 65 and head portion 60, thereby providing support for the anatomy of the user.

As noted above, the front of the neck of protective suit 15 preferably comprises elastic mesh 100 and does not include the aforementioned fluid bladder, so that the neck of protective suit 15 bends easily and so that the front of the neck of protective suit 15 does not tighten when fluid is driven into the neck portion of protective suit 15 (which could restrict the breathing of a user).

In one preferred form of the invention, the sides and rear of neck portion 65 comprise horizontal maze passageways (or channels) 120 and posterior vertical maze passageways (or channels) 125 which communicate with one another, and with the fluid reservoir of head portion 60 and shoulder portion 70, whereby to enable fluid flow between head portion 60 and shoulder portion 70. Horizontal maze passageways 120 and posterior vertical maze passageways 125 have a reduced cross-sectional area which absorbs energy as fluid from head portion 60 or shoulder portion 70 is forced through the reduced cross-sectional areas in neck portion 65. Furthermore, the reduced cross-sectional areas of horizontal maze passageways 120 and posterior vertical maze passageways 125 become stiffer when fluid from head portion 60 or shoulder portion 70 is forced into the reduced cross-sectional areas in neck portion 65. This increased stiffness of horizontal maze passageways 120 and posterior vertical maze passageways 125, combined with the orientation of the passageways, supports the user's neck against translational and rotational forces imparted to the user while still allowing the user's neck to bend. In one preferred form of the invention, horizontal maze passageways 120 and posterior vertical maze passageways 125 are formed by sealing together outer wall 105 and inner wall 110 at selected locations (e.g., by stitching, glueing, melting, etc.), whereby to form the fluid-directing passageways 120 and 125.

Protective suit 15 preferably includes at least one valve 130, with the at least one valve 130 being set so that if the pressure imposed on the valve exceeds a threshold, the valve "pops", indicating that the user needs to be examined for concussion or other injury. More particularly, when outer wall 105 of protective suit 15 receives a force which is greater than a selected magnitude (e.g., from an impact of excessive force), the fluid contained within fluid reservoir 115 exerts a force against the at least one valve 130 which "pops" the valve, thereby indicating that the user needs to be examined for concussion or other injury.

If desired, valve 130 may be set to "pop" at a "standard" trigger point (i.e., the same trigger point for all users), or valve 130 may be configured so it will "pop" at a personalized trigger point for an individual user (e.g., based on the user's height, weight, concussive history, etc.). The ability to set personalized trigger points for individual users can be highly beneficial for a user who has had multiple previous concussive injuries to the head and therefore might want or need valve 130 to "pop" at a lower selected magnitude of force upon an impact to the head. In one preferred form of the invention, when the at least one one-way valve "pops", indicator light 30 on helmet 10 is lit, thereby alerting surrounding individuals that the user needs to be examined for concussion or other injury.

3. Novel Temperature Conditioning Unit 20

Temperature conditioning unit 20 helps regulate the user's body temperature.

In addition, temperature conditioning unit 20 can be used to intentionally cool the user's body, and particularly the user's head, when the user has received an impact of significant force (e.g., a force large enough to "pop" the at least one valve 130 and light up indicator light 30) and serious injury may have occurred (e.g., a concussion may have been received).

More particularly, temperature conditioning unit 20 is connected to the fluid bladder of protective suit 15, e.g., by tubing 135 which attaches to at least fluid connector 136, such that fluid from the fluid bladder can be passed through temperature conditioning unit 20 where the fluid is temperature-regulated. Temperature conditioning unit 20 comprises a motorized fluid pump, and cooling and/or heating apparatus to cool and/or heat the fluid within the fluid bladder of protective suit 15. Temperature conditioning unit 20 also comprises flow and temperature controls. Thus, temperature conditioning unit 20 essentially comprises an external fluid management system which regulates the temperature of the fluid in the bladder of protective suit 15 to the appropriate temperature so as to help temperature-regulate the user's body temperature and/or to provide body cooling in the event that there is fear that a serious injury may have occurred.

By way of example but not limitation, temperature conditioning unit 20 may be configured so as to adjust the temperature of protective suit 15 in an effort to maintain the user at a desired "set" temperature so as to prevent heat illness or cold illness and/or to maximize the athletic performance of a user.

By way of further example but not limitation, temperature conditioning unit 20 can be configured to rapidly chill the user where there is a fear that the user may have undergone a serious injury. Such rapid cooling may help mitigate an injury (e.g., such as is the case of a concussion).

Temperature conditioning unit 20 may also be used to set the initial pressure of the fluid within the fluid bladder. More particularly, in one form of the invention, temperature conditioning unit 20 may be connected to the fluid bladder and fluid either flowed into the fluid bladder (i.e., to increase the pressure in the fluid bladder) or pulled out of the fluid bladder (i.e., to decrease the pressure in the fluid bladder).

And in one preferred form of the invention, temperature conditioning unit 20 is configured to adjust the fluid pressure in the fluid bladder to a particular pressure in order to personalize the protection of a user based on a user's height, weight, concussive history or other parameters.

For applications where the user must walk or run about (e.g., most sports applications, military field deployments, etc.), it is anticipated that one temperature conditioning unit 20 would be provided for every 10-20 protective suits 15, since temperature conditioning unit 20 is generally only used when the user is stationary (e.g., where a player has left the playing field, where a soldier has come in from the field, etc.). However, for other applications where the user does not need to walk about (e.g., motor sports where the user is seated, military applications where the soldier is riding in a vehicle, etc.), one temperature conditioning unit 20 could be provided for each protective suit 15.

It is anticipated that in one preferred form of the invention, temperature conditioning unit 20 will most often be used to lower a user's body temperature (i.e., to cool the user).

4. Solid-State Fluid Conditioning

Figure 11:
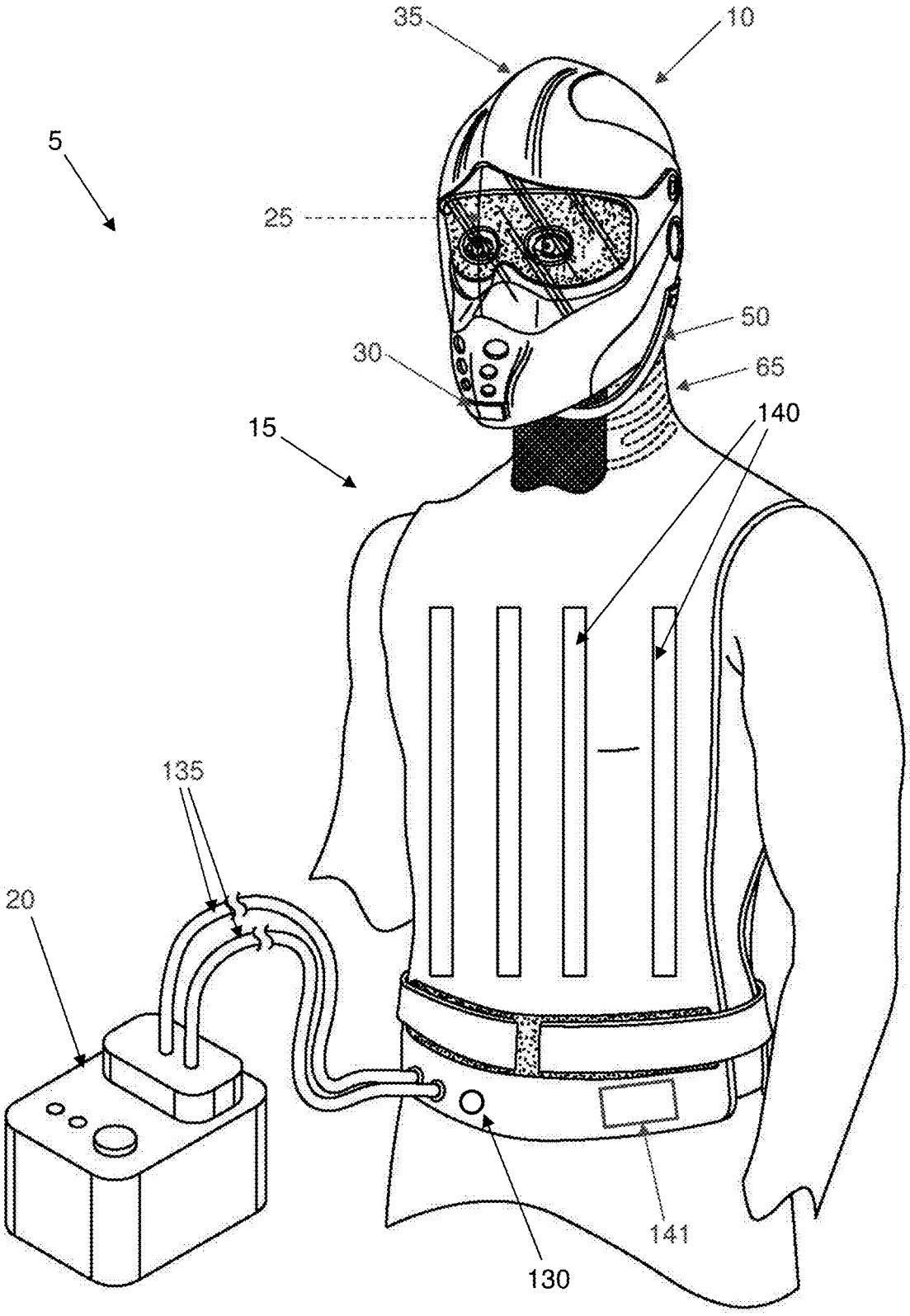
FIGS. 11 and 12 are schematic views showing another novel protective suit formed in accordance with the present invention.
Figure 12:
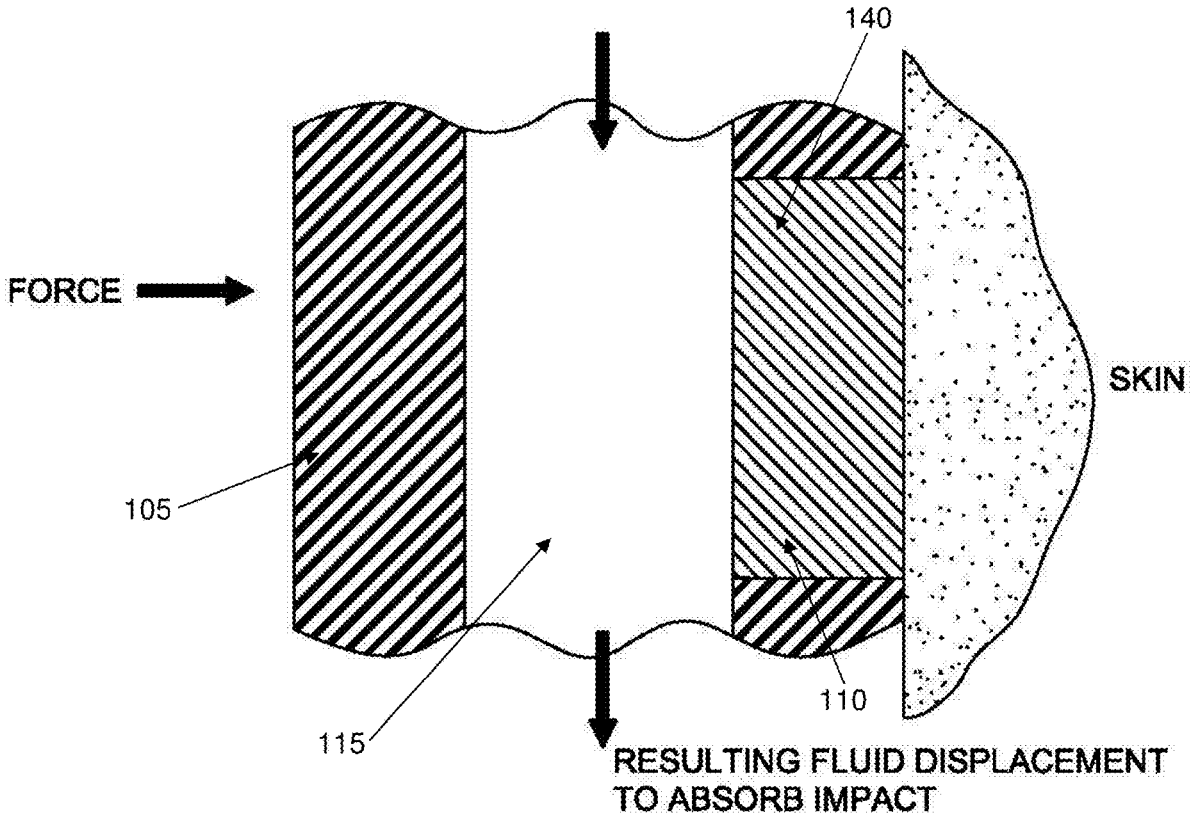

In another preferred form of the invention, and looking next at FIGS. 11 and 12, one or more thermoelectric heat pumps 140, and a power supply (e.g., a battery pack) 141, are incorporated in protective suit 15. More particularly, thermoelectric heat pumps are solid-state active heat pumps which transfer heat from one side of the heat pump to the other side of the heat pump, consuming electrical energy. The direction of heat flow depends on the direction of the electric current. In the present invention, one or more thermoelectric heat pumps 140 are incorporated into protective suit 15 by positioning the heat pumps within fluid reservoir 115, or within or against outer wall 105 and/or inner wall 110.

In one preferred form of the present invention, thermoelectric heat pumps 140 are positioned within inner wall 110, with one side of the thermoelectric heat pump 140 in contact with the skin of the user and the opposite side of the thermoelectric heat pump in contact with the fluid in fluid reservoir 115. In one form of the invention, the thermoelectric heat pumps transfer heat from the skin of the user to the fluid in the fluid reservoir, whereby to lower the body temperature of the user. The heated fluid is then passed through temperature conditioning unit 20 where the fluid is temperature-regulated, e.g., cooled. Of course, if it should be desired to provide heat to the user, the direction of the electrical current supplied to thermoelectric heat pumps 140 is reversed, so that heat is directed into the skin of the user by thermoelectric heat pumps 140. In this case, temperature conditioning unit 20 may be used to supply heat to the fluid in the fluid reservoir.

Preferably thermoelectric heat pumps 140 are incorporated in each of head portion 60, neck portion 65, shoulder portion 70, chest portion 75 and back portion 80, although they may be omitted from one or more of these portions if desired.

In one form of the invention, temperature controls (not shown) for thermoelectric heat pumps 140 may be provided on protective suit 15 or on power supply 141, with appropriate wiring (not shown) extending between the temperature controls (not shown) and thermoelectric heat pumps 140.

In another form of the invention, temperature controls (not shown) for thermoelectric heat pumps 140 may be provided on temperature conditioning unit 20, with appropriate wiring (not shown) extending between the temperature controls (not shown) and thermoelectric heat pumps 140.

Second Construction

Figure 13:
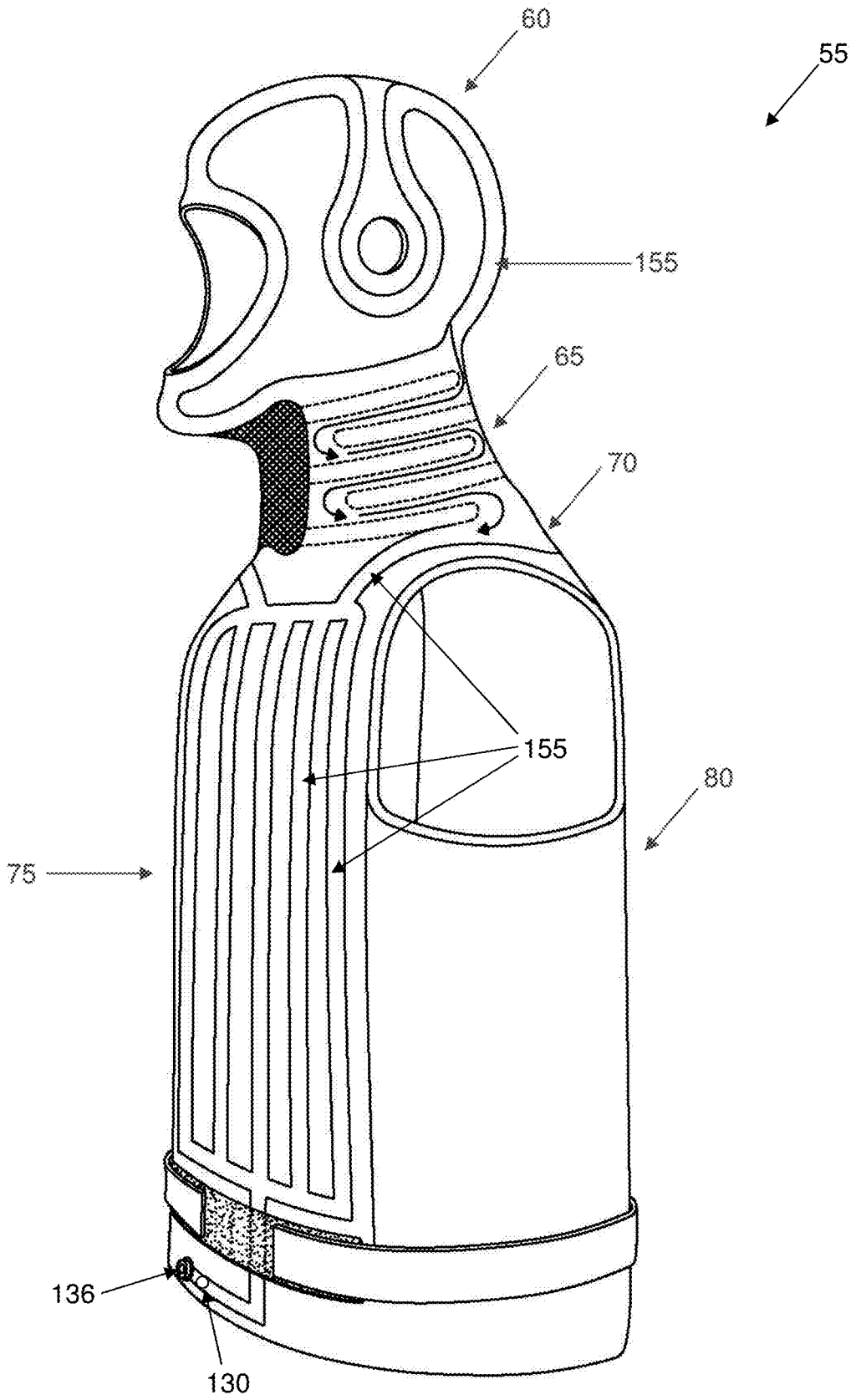
FIGS. 13 and 14 are schematic views showing another novel protective suit formed in accordance with the present invention.
Figure 14:
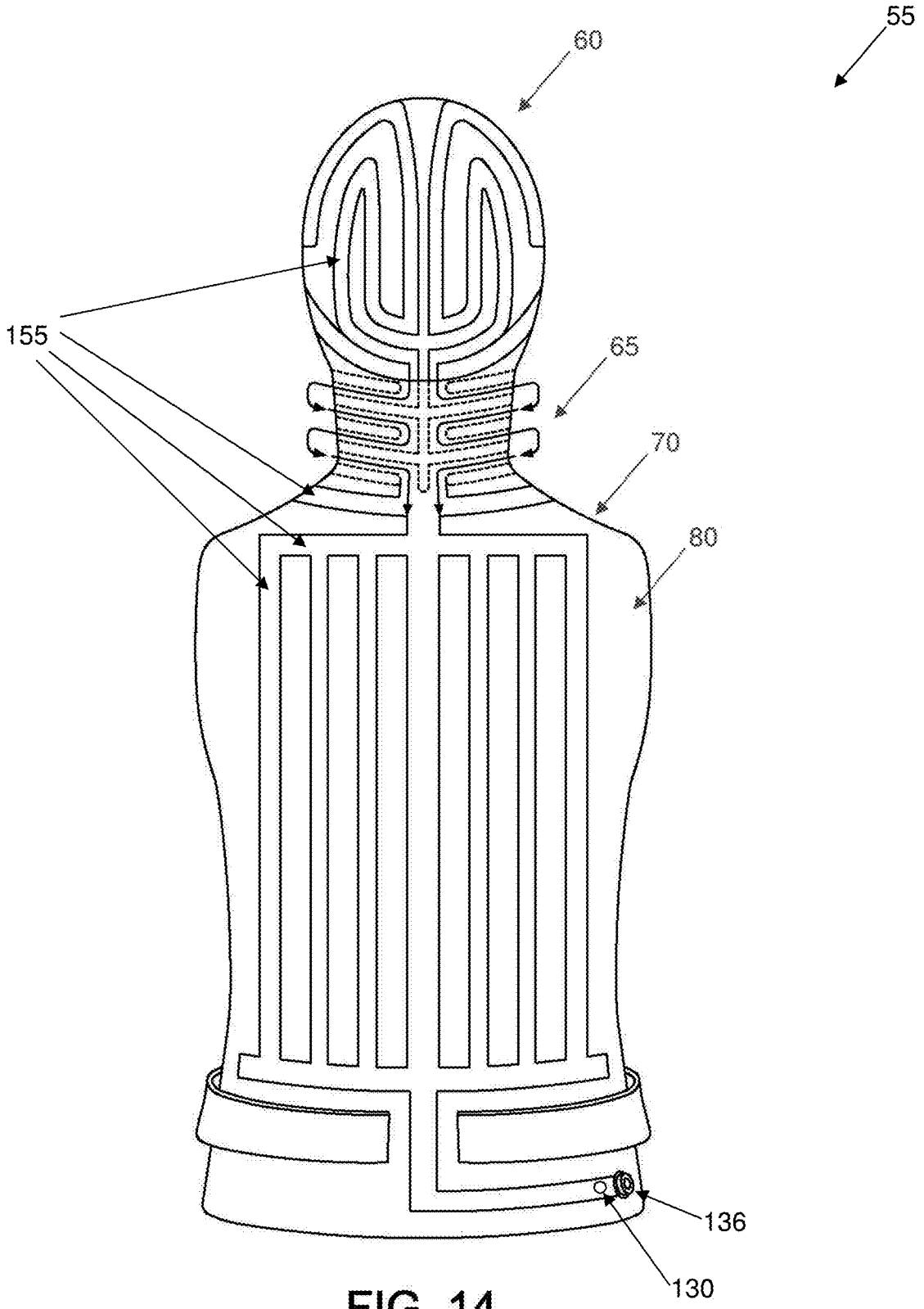
Figure 15:
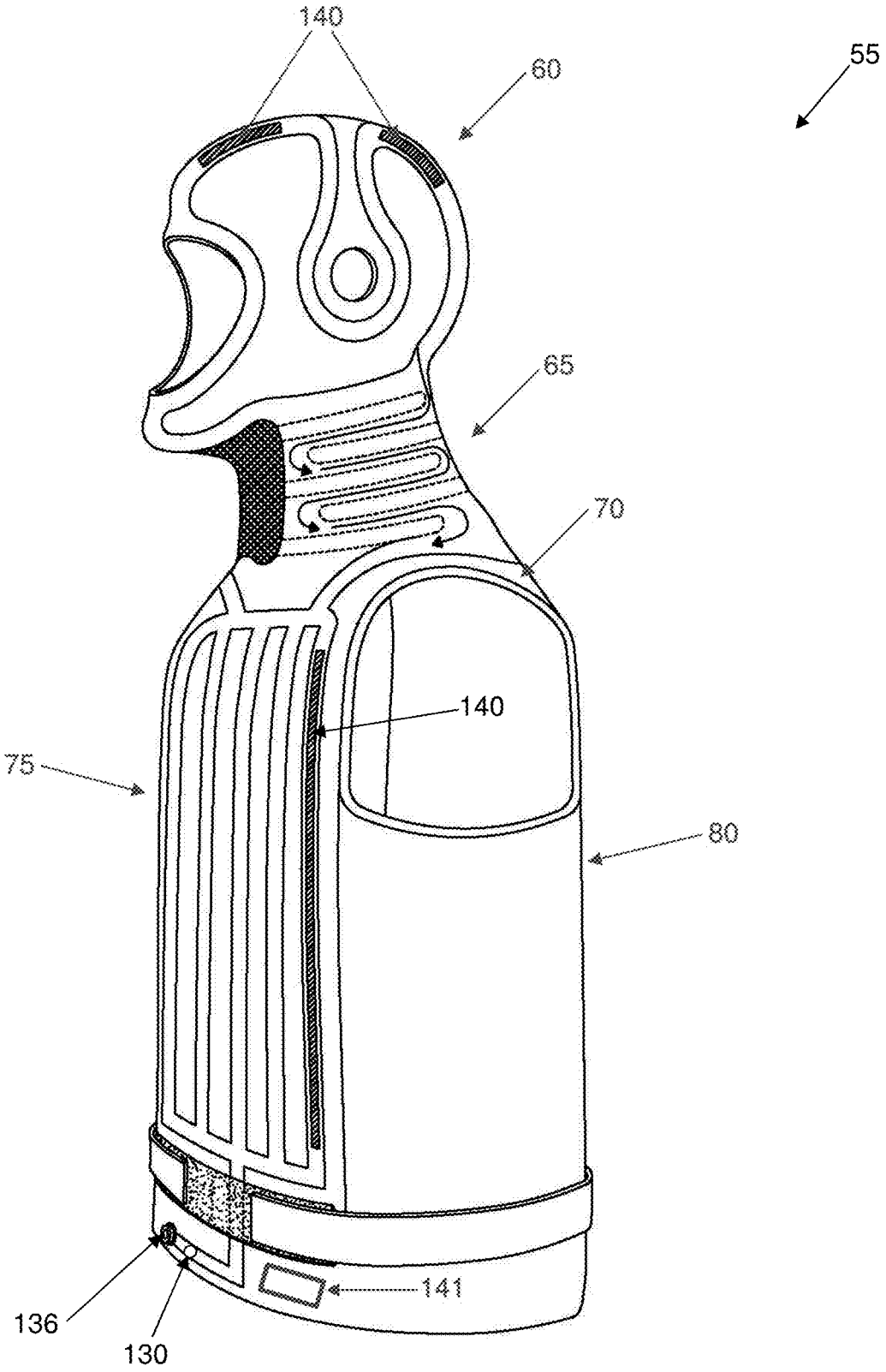
FIGS. 15 and 16 are schematic views showing another novel protective suit formed in accordance with the present invention.
Figure 16:
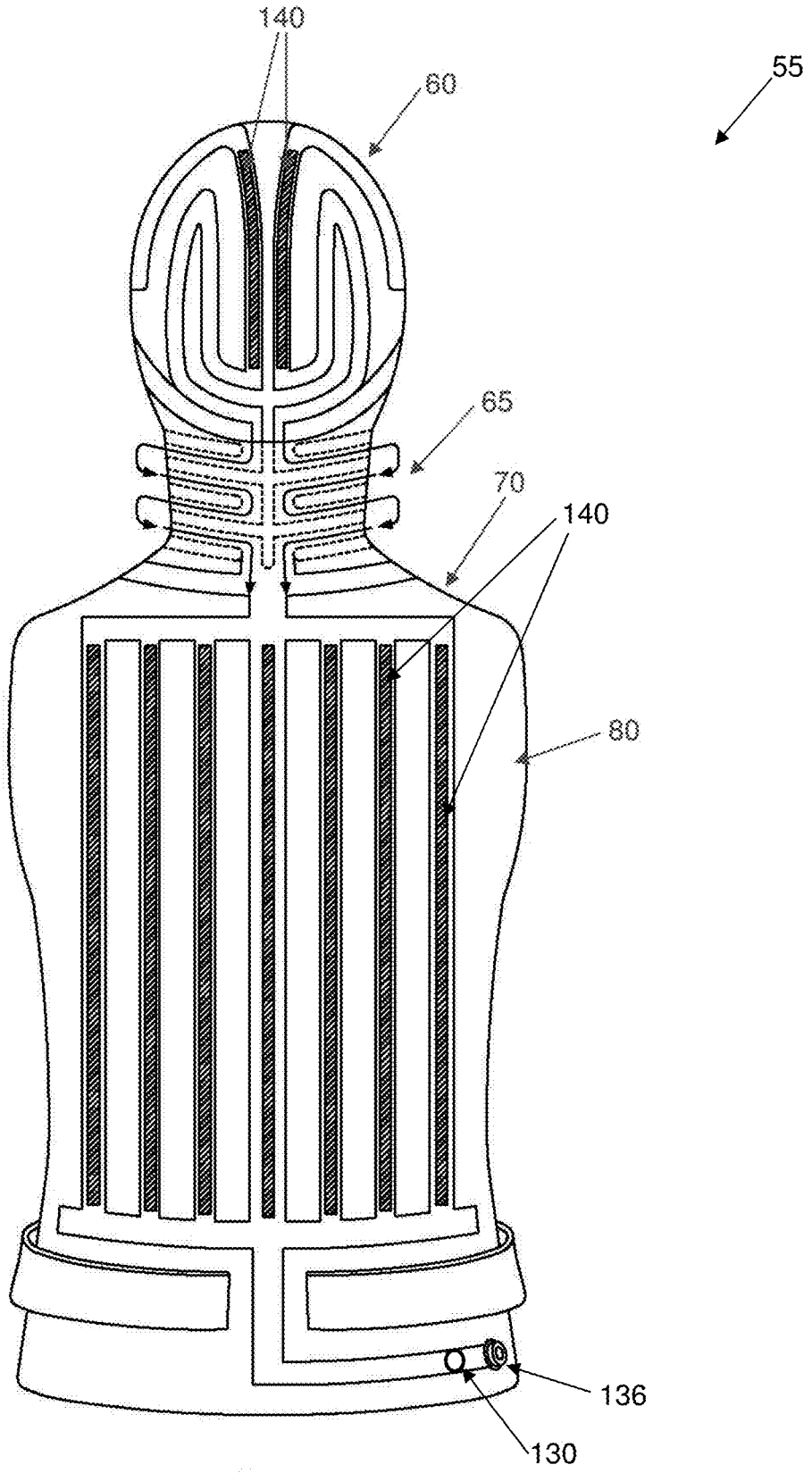

In another form of the invention, and looking now at FIGS. 13 and 14, the fluid reservoir in head portion 60, shoulder portion 70, chest portion 75 and back portion 80 is subdivided into passageways (or channels) 155 which communicate with one another, and with horizontal maze passageways 120 and posterior vertical maze passageways 125 of neck portion 65. In other words, the fluid reservoir in head portion 60, shoulder portion 70, chest portion 75 and back portion 80 is subdivided into passageways (or channels) in a manner similar to the way in which the fluid reservoir in neck portion 65 is subdivided into horizontal maze passageways 120 and posterior vertical maze passageways 125. The aforementioned at least one fluid connector 136 is connected to passageways 155, e.g., in chest portion 75. It should be appreciated that in this form of the invention, passageways 155 effectively form one continuous "tube" of fluid running through protective suit 15.

Passageways 155 have a reduced cross-sectional area which absorbs energy as fluid from an impacted portion of protective suit 15 is forced into another portion of the protective suit. Furthermore, the reduced cross-sectional areas of passageways 155 become stiffer when fluid from an impacted portion of the protective suit 15 is forced into another portion of the protective suit. This increased stiffness of passageways 155, combined with the orientation of the passageways, supports the user's body against translational and rotational forces imparted to the user while still allowing the user's body to bend. It will be appreciated that passageways 155 may have a particular configuration in each of head portion 60, shoulder portion 70, chest portion 75 and back portion 80 so as to provide maximum protection and support for the particular anatomy adjacent to a given portion of protective suit 15.

In one preferred form of the invention, passageways 155 are formed by sealing together outer wall 105 and inner wall 110 at selected locations (e.g., by stitching, glueing, melting, etc.), whereby to form the fluid-directing passageways 155.

In one preferred form of the invention, elastic mesh (similar to elastic mesh 100 of neck portion 65) may be provided in the space between the passageways 155 formed in head portion 60, shoulder portion 70, chest portion 75 and back portion 80, whereby to lighten those portions and whereby to increase the "breathability" of those portions.

Third Construction

In the foregoing constructions, the fluid reservoir of protective suit 15 comprises a single reservoir, in the sense that the fluid in any one of head portion 60, neck portion 65, shoulder portion 70, chest portion 75 and back portion 80 communicates with the fluid in any other one of head portion 60, neck portion 65, shoulder portion 70, chest portion 75 and back portion 80.

However, if desired, the fluid reservoir of protective suit 15 may comprise a plurality of reservoirs, with each reservoir being formed in one or more of head portion 60, neck portion 65, shoulder portion 70, chest portion 75 and back portion 80. Such a construction may be desirable for a number of reasons, e.g., to facilitate temperature conditioning of a selected portion of the protective suit 15 (e.g., head portion 60 and neck portion 65), to better accommodate multiple simultaneous impacts on different portions of the protective suit (e.g., simultaneous impacts to head portion 60 and shoulder portion 70), etc.

Figure 17:
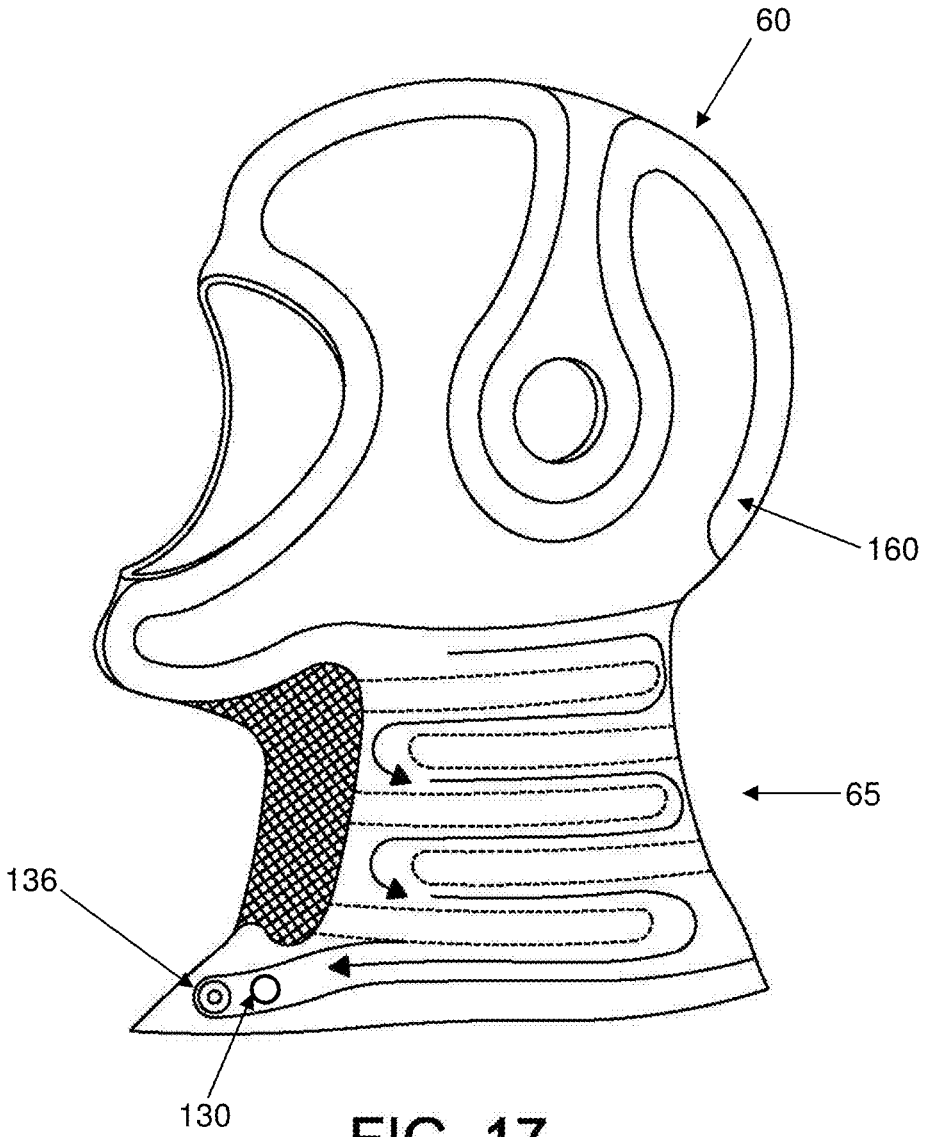
FIGS. 17-23 are schematic views showing another novel protective suit formed in accordance with the present invention.
Figure 18:
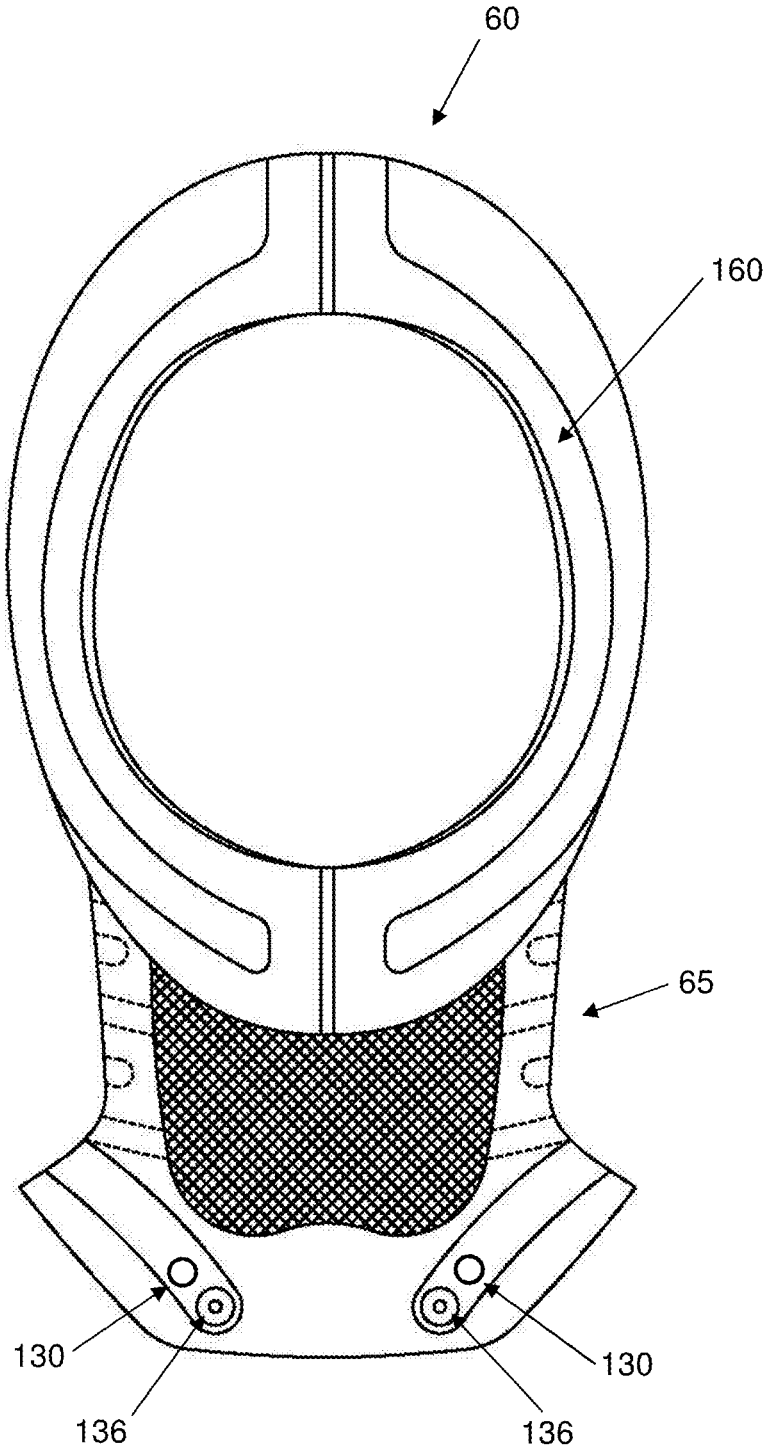
Figure 19:
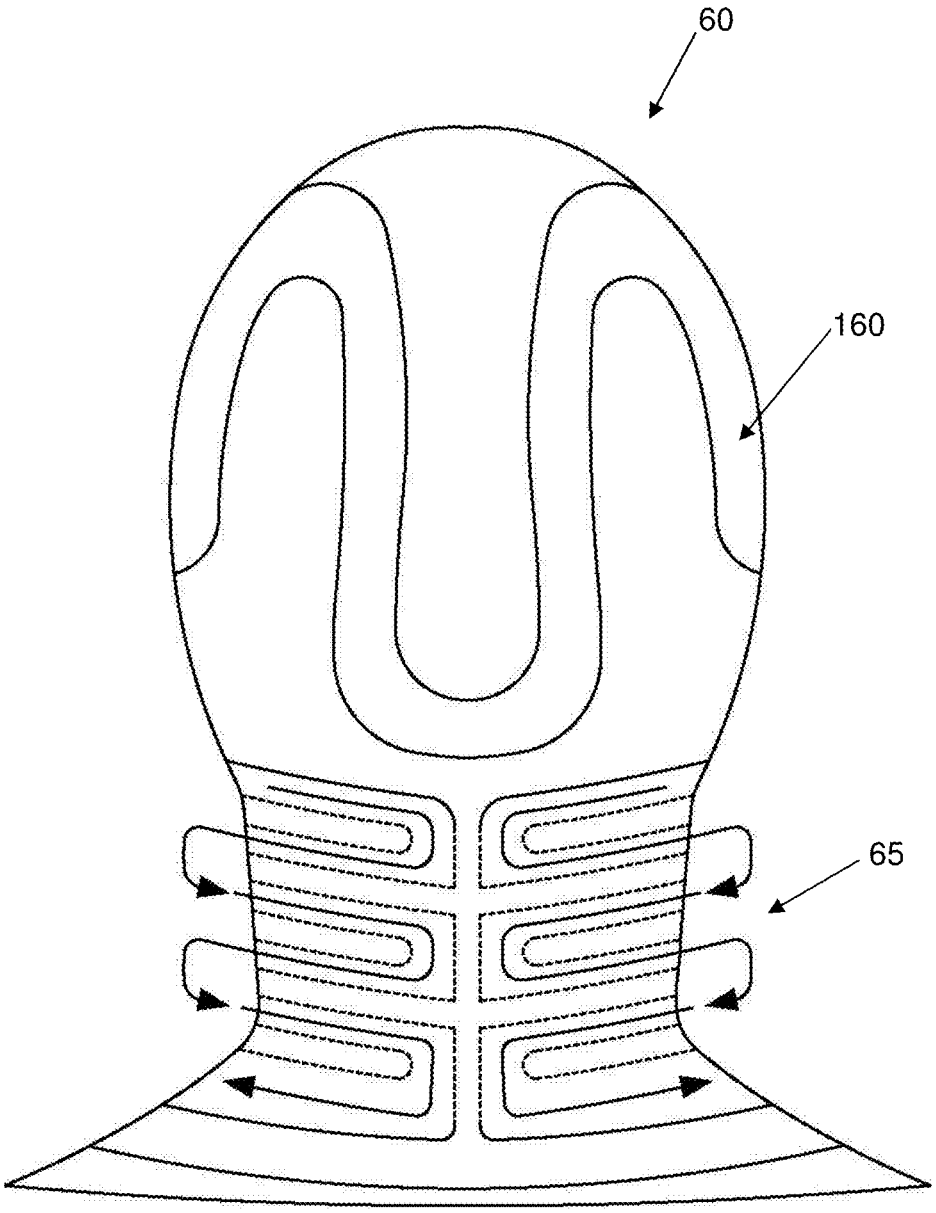
Figure 20:
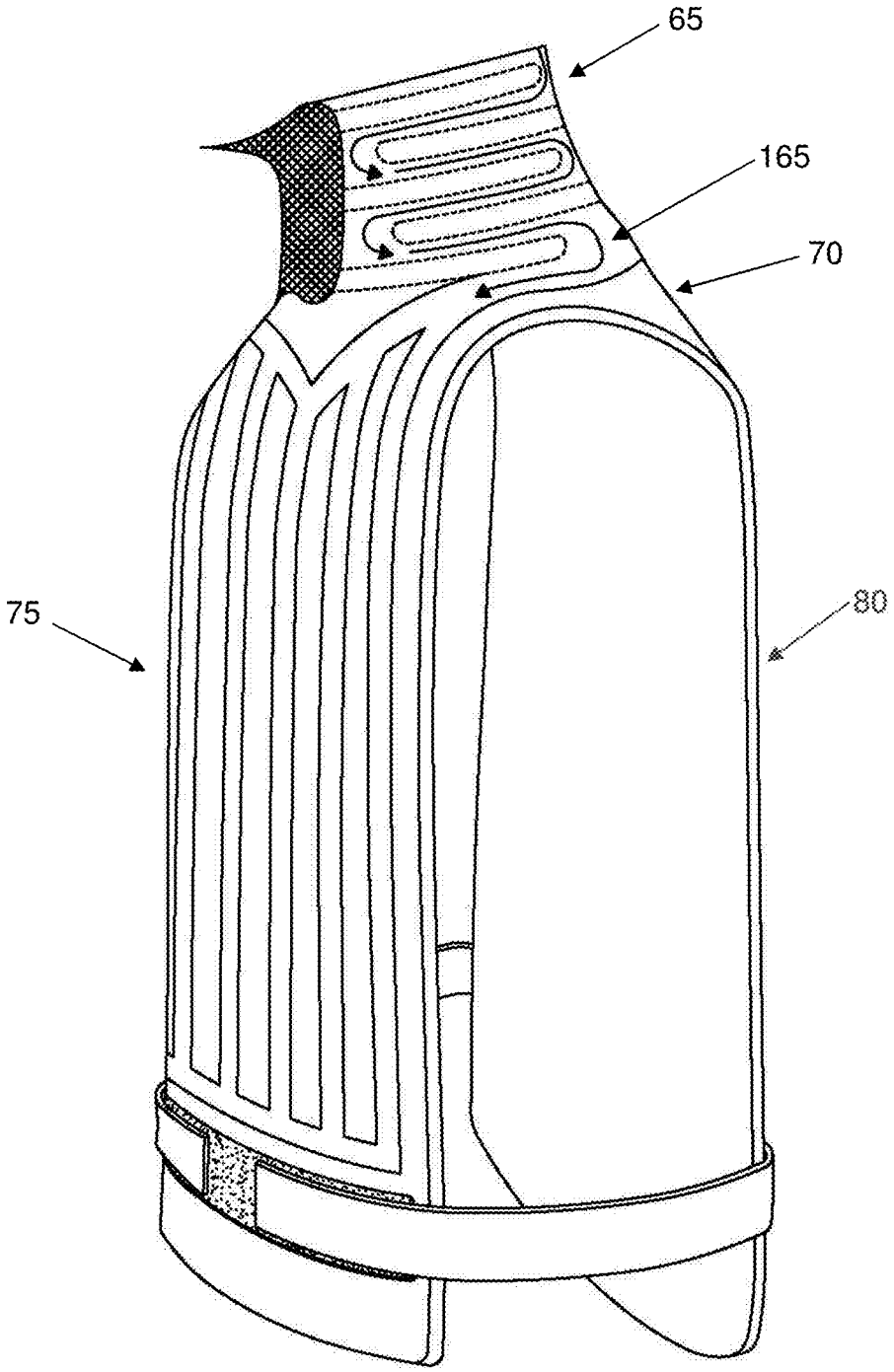
Figure 21:
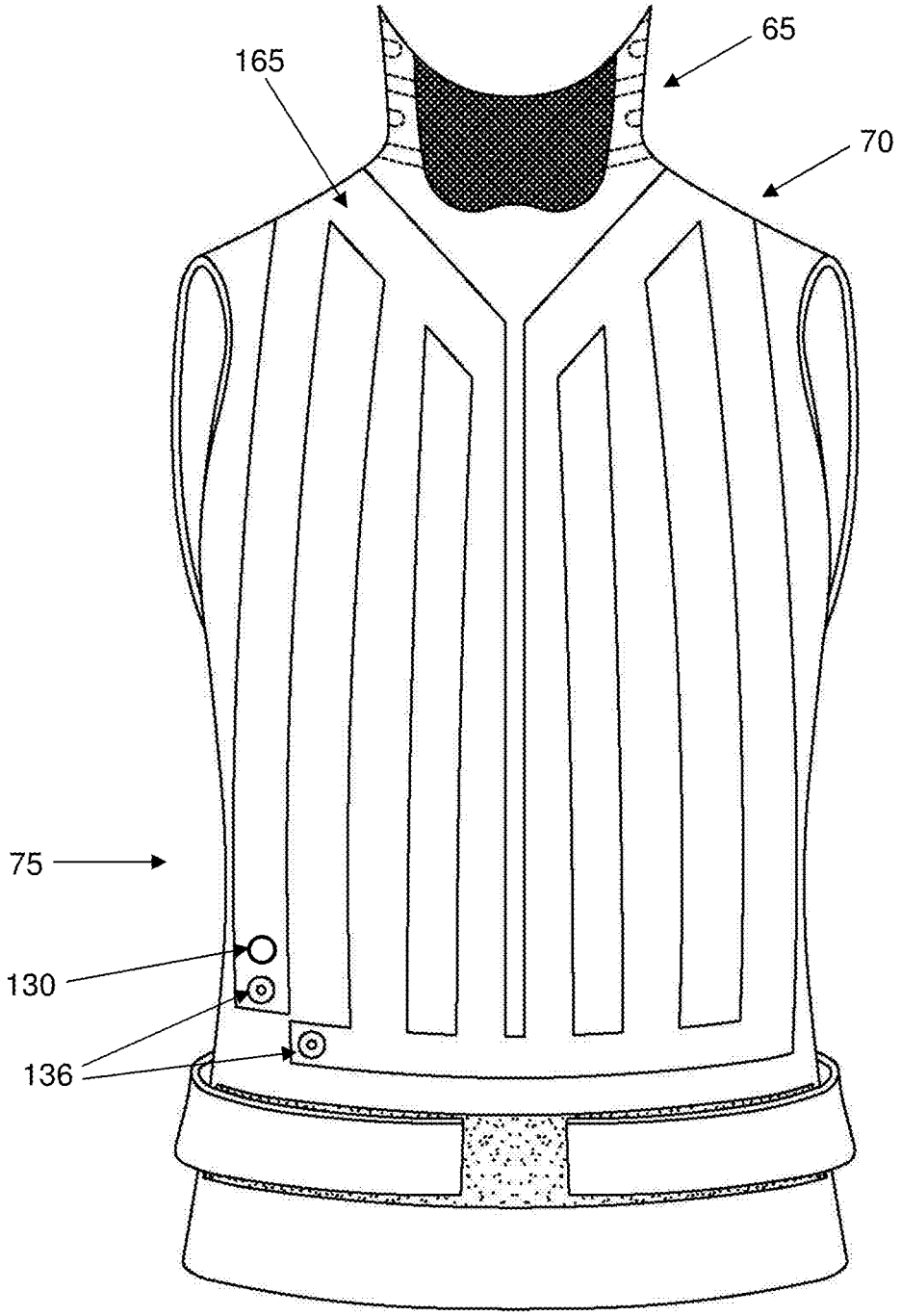
Figure 22:
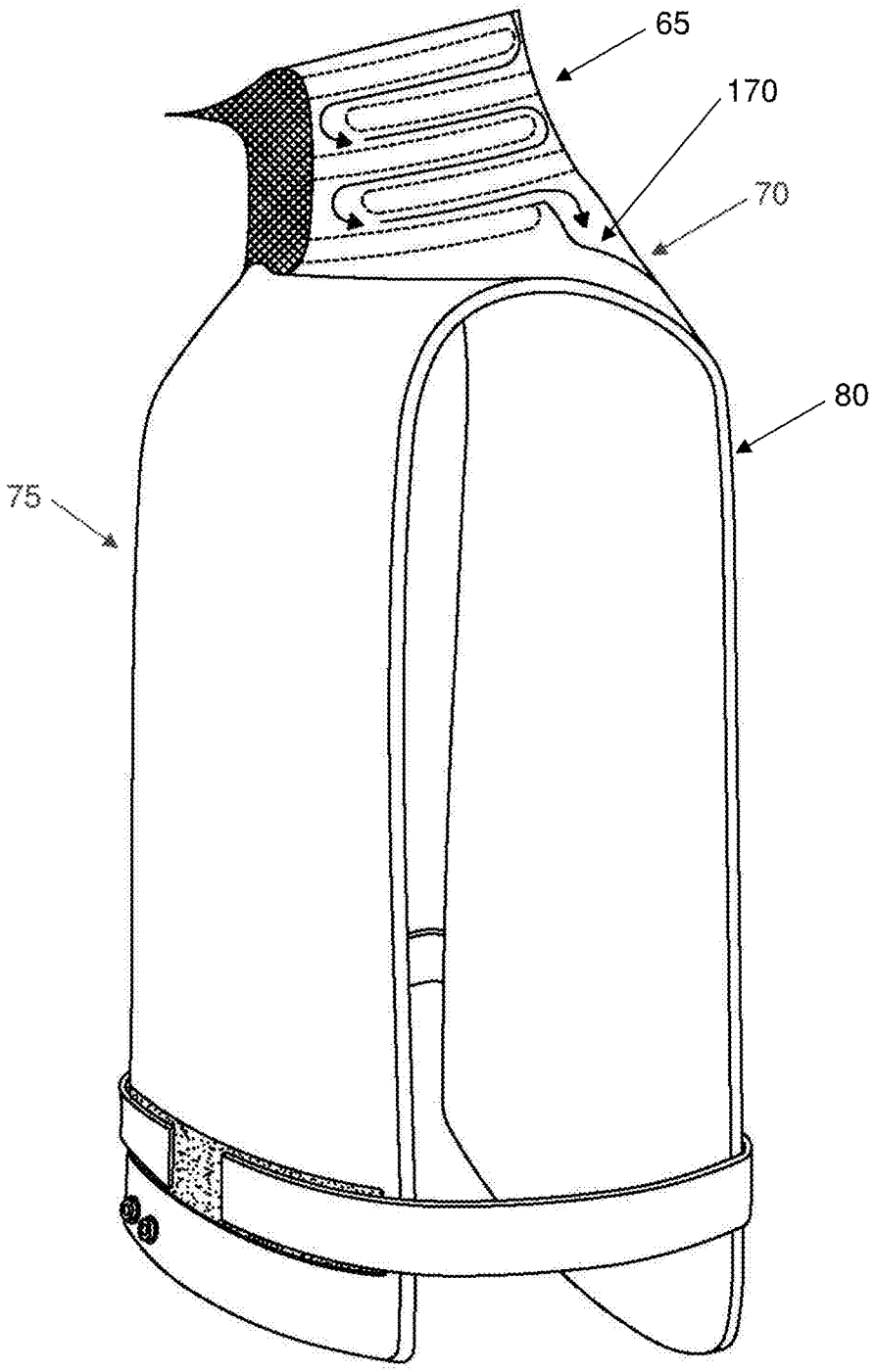
Figure 23:
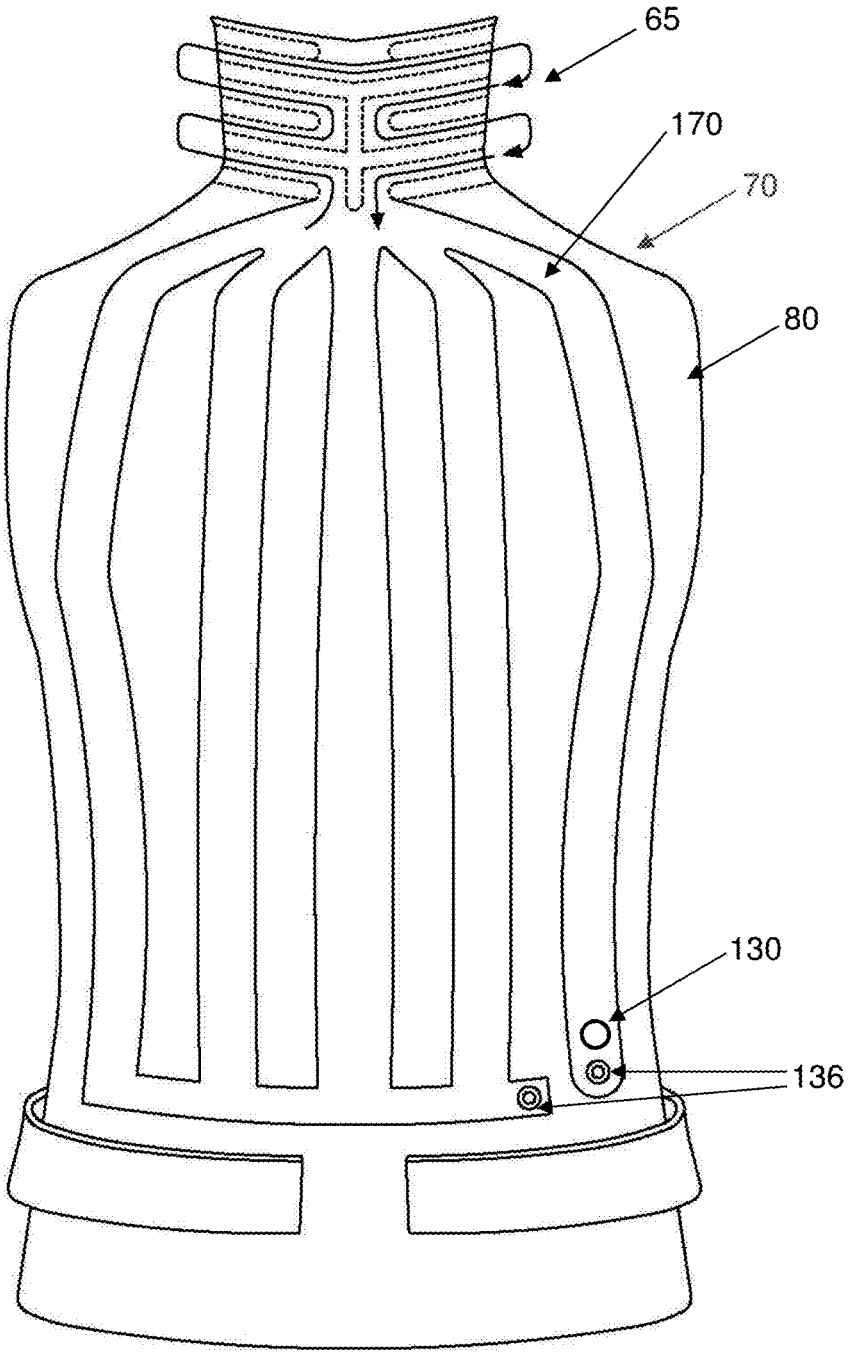

By way of example but not limitation, in one preferred form of the invention, the fluid reservoir of protective suit 15 may comprise three separate reservoirs, i.e., a first fluid reservoir 160 for head portion 60 and neck portion 65 (see FIGS. 17-19), a second fluid reservoir 165 for neck portion 65, shoulder portion 70 and chest portion 75 (see FIGS. 20 and 21), and a third fluid reservoir 170 for neck portion 65, shoulder portion 70 and back portion 80 (see FIGS. 22 and 23). It will be appreciated that each separate reservoir comprises at least one fluid connector 136 so as to enable fluid to be sent to temperature conditioning unit 20. It will also be appreciated that each reservoir preferably comprises its own valve 130 for indicating when an impact of a given magnitude has occurred with respect to that reservoir.

Where a given portion of protective suit 15 contains the fluid passageways for more than one fluid reservoir (e.g., where neck portion 65 contains fluid passageways for first fluid reservoir 160, second fluid reservoir 165 and third fluid reservoir 170), the fluid passageways for the multiple fluid reservoirs may be placed alongside one another, laterally displaced from one another.

Figure 24:
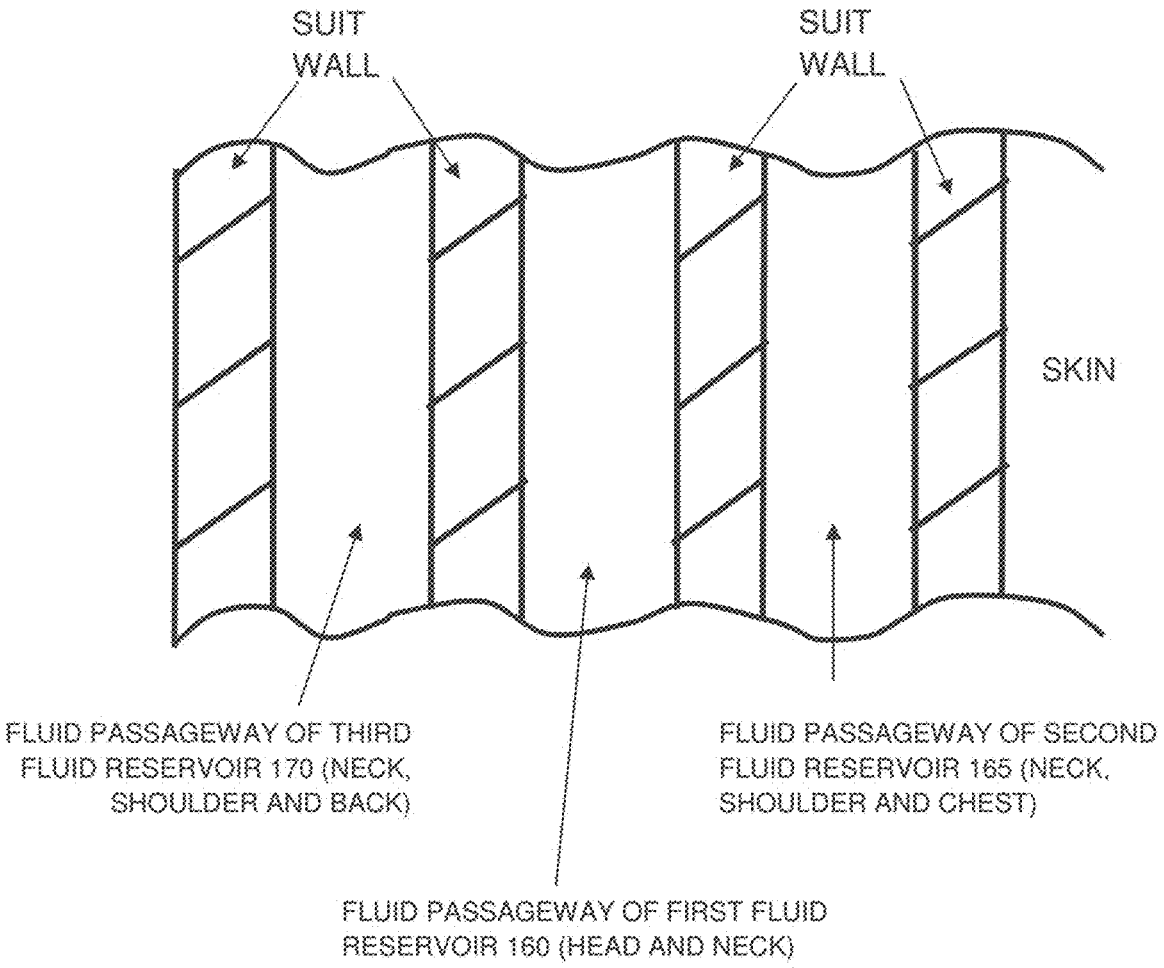
FIG. 24 is a schematic view showing aspects of another novel protective suit formed in accordance with the present invention.

Alternatively, where a given portion of protective suit 15 contains the fluid passageways for more than one fluid reservoir (e.g., where neck portion 65 contains fluid passageways for first fluid reservoir 160, second fluid reservoir 165 and third fluid reservoir 170), the fluid passageways for the multiple fluid passageways may be placed over one another, vertically displaced from one another. By way of example but not limitation, FIG. 24 shows one exemplary construction where neck portion 65 of protective suit 15 contains fluid passageways for first fluid reservoir 160, second fluid reservoir 165 and third fluid reservoir 170. More particularly, in this exemplary construction, the fluid passageways of first fluid reservoir 160 (head and neck) overlay the fluid passageways of second fluid reservoir 165 (neck, shoulder and chest) and the fluid passageways of third fluid reservoir 170 (neck, shoulder and back) overlay the fluid passageways of first fluid reservoir 160 (head and neck).

It should be appreciated that in any construction where fluid passageways are used, the configurations (e.g., diameters) of the fluid passageways, and/or the elasticity of the walls of the passageways, can be varied so as to preferentially direct fluid flow. In one preferred form of the invention, the fluid passageways are configured so as to preferentially direct fluid flow towards the neck of the user.

Different Grades of Novel System 5

In one preferred form of the invention, system 5 may be provided in three different "grades" of systems:

(i) "collision sport grade" (e.g., football, hockey, lacrosse, etc.);

(ii) "vehicle grade" (e.g., motorcycle, mountain/dirt bike, snowmobile, etc.); and (iii) "military grade" (e.g., armed forces, SWAT, etc.).

The collision sport grade system is the "basic" system. Helmet 10 may be formed out of impact-resistant plastic. Standard football, hockey, lacrosse, etc. pads may be worn over protective suit 15.

The vehicle grade system is similar to the "basic" system but the vest (i.e., shoulder portion 70, chest portion 75 and back portion 80) of protective suit 15 is supplemented with sleeves so as to constitute a full shirt top, preferably with built-in Kevlar™ padding. Helmet 10 may be reinforced with non-plastic materials, e.g., Kevlar™. With this form of the invention, the depressurization indicator (i.e., indicator light 30) may be located on the vest (e.g., on chest portion 75), and no indicator light 30 may be provided on helmet 10.

The military grade system is similar to the vehicle grade system but preferably includes bulletproof padding. The military grade system may also include fluid-based exoskeletal body armor in the form of separate pants with bulletproof padding. In this form of the invention, there may be two temperature conditioning units 20, one for the shirt and one for the pants (or the shirt and pants may carry thermoelectric heat pumps 140). Helmet 10 is preferably military grade, e.g., bulletproof. The depressurization indicator (i.e., indicator light 30) is on the shirt (e.g., on chest portion 75), and no indicator light 30 may be provided on helmet 10.

Example

Figure 25:
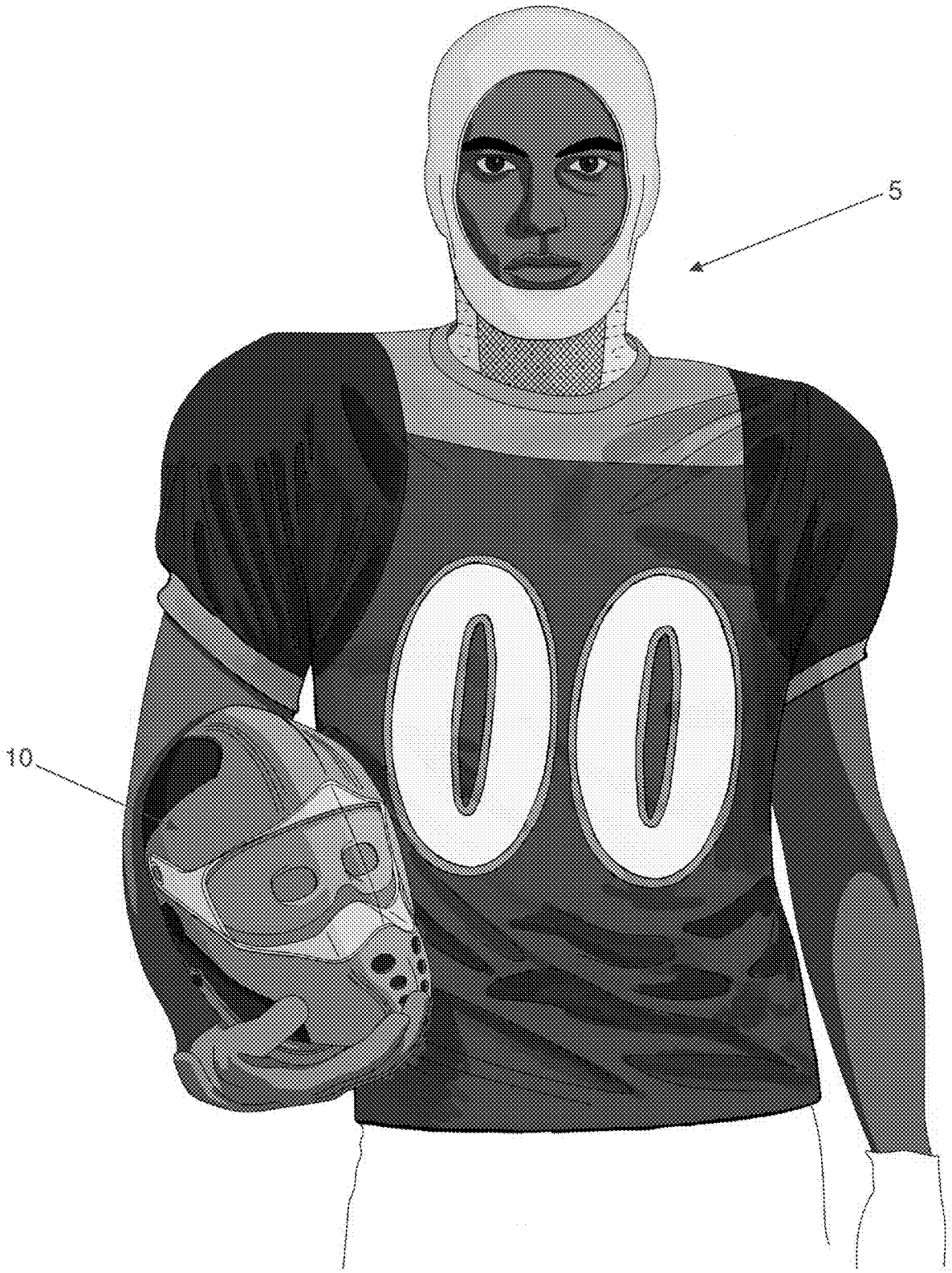
FIGS. 25 and 26 are schematic views showing an exemplary application for the fluid-based exoskeletal body armor of the present invention.
Figure 26:
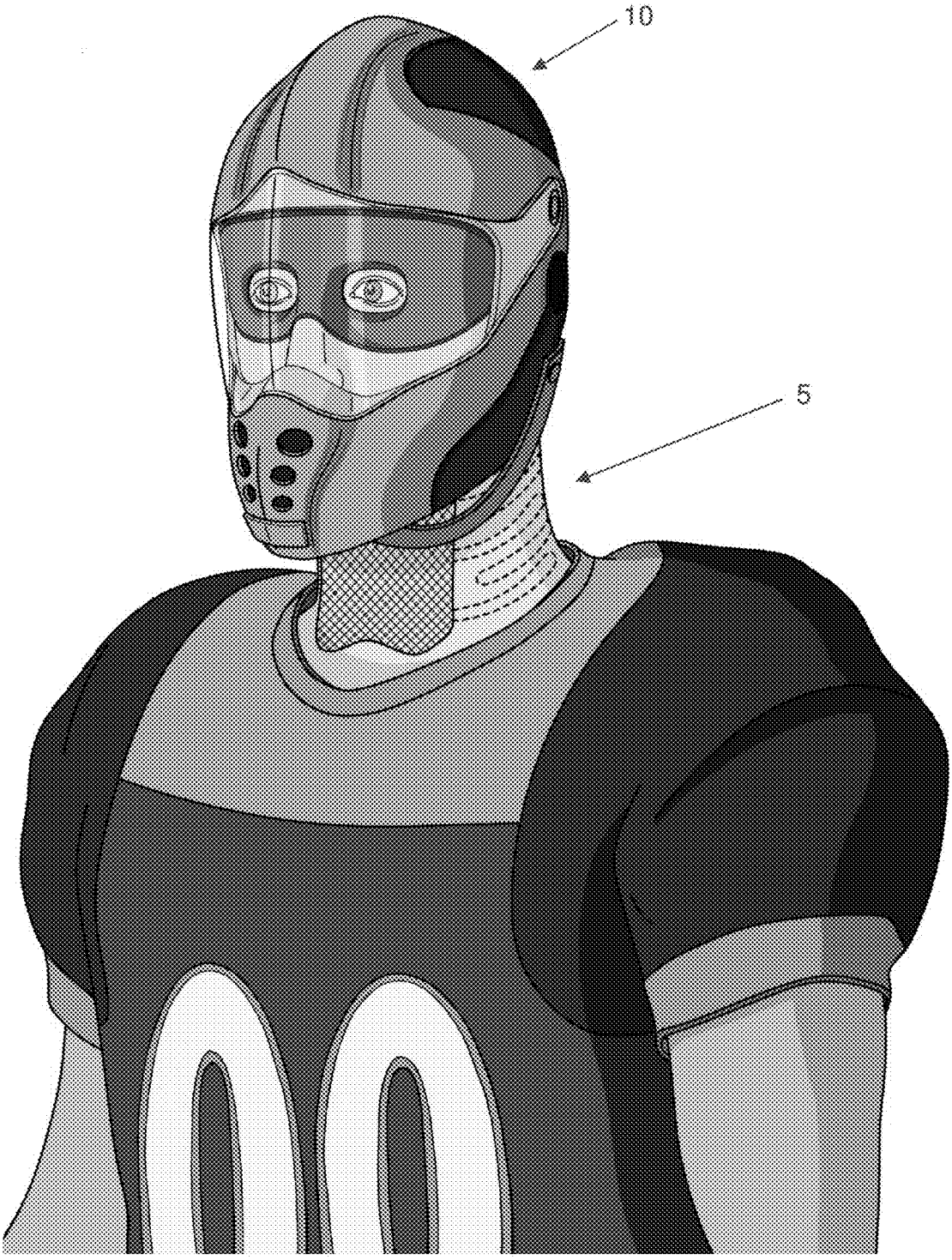

FIGS. 25 and 26 show an exemplary application for the fluid-based exoskeletal body armor of the present invention: in FIG. 25, a football player is shown wearing protective suit 5 and holding helmet 10, and in FIG. 26 a football player is shown wearing protective suit 5 and wearing helmet 10.

Modifications of the Preferred Embodiments

It should be understood that many additional changes in the details, materials, steps and arrangements of parts, which have been herein described and illustrated in order to explain the nature of the present invention, may be made by those skilled in the art while still remaining within the principles and scope of the invention.

What is claimed is:

1. A protective system comprising:

a protective suit capable of withstanding a force of an impact without tearing, the protective suit comprising:

a head portion, wherein the head portion is configured to cover at least a portion of a head of a wearer;

a neck portion connected to the head portion, wherein the neck portion is configured to cover a neck of the wearer;

a torso portion connected to the neck portion, wherein the torso portion is configured to cover at least a portion of a torso of the wearer; and a fluid bladder formed in the neck portion and at least one of the head portion and the torso portion, the fluid bladder containing a fluid;

wherein the neck portion comprises an anterior portion, a right portion connected to the anterior portion, a posterior portion connected to the right portion, and a left portion connected to the posterior portion and the anterior portion;

wherein the anterior portion of the neck portion comprises an elastic mesh; and wherein the fluid bladder in the neck portion comprises at least one passageway of reduced cross-sectional area configured to extend in an arcuate manner about a portion of the neck of the wearer in the right portion of the neck portion, the posterior portion of the neck portion, or the left portion of the neck portion, the at least one passageway being configured such that a force of an impact on the fluid bladder in at least one of the head portion and the torso portion preferentially directs fluid towards the at least one passageway in the neck portion so as to cause the at least one passageway to stiffen to support the neck of the wearer against translational and rotational forces.

2. A protective system according to claim 1 wherein the torso portion comprises:

a shoulder portion;

a front portion; and a back portion.

3. A protective system according to claim 1 further comprising a pair of sleeve portions.

4. A protective system according to claim 1 further comprising a pants portion.

5. A protective system according to claim 1 wherein the at least one passageway comprises a plurality of horizontal passageways and a plurality of vertical passageways.

6. A protective system according to claim 5 wherein the plurality of horizontal passageways and the plurality of vertical passageways are configured so as to support the neck of the wearer against translational and rotational forces.

7. A protective system according to claim 1 wherein the fluid bladder is formed by an outer wall and an inner wall, and further wherein the at least one passageway is formed by sealing together the outer wall and the inner wall at selected locations.

8. A protective system according to claim 1 wherein the fluid bladder in at least one of the head portion and the torso portion comprises a plurality of additional passageways of reduced cross-sectional area, the plurality of additional passageways being configured such that the force of the impact on the fluid bladder causes the additional passageways to stiffen to support at least one of the head and the torso of the wearer.

9. A protective system according to claim 8 wherein the fluid bladder is formed in both the head portion and the torso portion and comprises a plurality of additional passageways of reduced cross-sectional area.

10. A protective system according to claim 1 wherein the fluid comprises a liquid.

11. A protective system according to claim 1 wherein the fluid comprises a gas.

12. A protective system according to claim 1 further comprising an alert indicator for indicating when a force of an impact on the fluid bladder exceeds a predetermined threshold, wherein the alert indicator comprises a pop valve which changes state when the force of the impact on the fluid bladder exceeds a predetermined threshold.

13. A protective system according to claim 12 wherein the pop valve is configured so that the predetermined threshold is individually adjustable.

14. A protective system according to claim 12 wherein the predetermined threshold is adjusted based on at least one from the group consisting of: wearer height, wearer weight, and wearer concussive history.

15. A protective system according to claim 1 further comprising an alert indicator for indicating when a force of an impact on the fluid bladder exceeds a predetermined threshold, wherein the alert indicator comprises an indicator light which lights up when the force of the impact on the fluid bladder exceeds a predetermined threshold.

16. A protective system according to claim 1 wherein an alert indicator is provided on each of the head portion, the neck portion and the torso portion.

17. A protective system according to claim 1 further comprising a temperature conditioning unit for temperature conditioning the protective suit.

18. A protective system according to claim 17 wherein the temperature conditioning unit is configured to temperature condition the fluid in the fluid bladder.

19. A protective system according to claim 18 wherein the temperature conditioning unit is configured to withdraw fluid from the fluid bladder, temperature condition the withdrawn fluid, and return the temperature-conditioned fluid to the fluid bladder.

20. A protective system according to claim 18 wherein the temperature conditioning unit is selectively connectable to the fluid bladder.

21. A protective system according to claim 20 wherein the temperature conditioning unit is provided separate from the protective suit.

22. A protective system according to claim 18 wherein the temperature conditioning unit is configured to adjust a temperature of the protective suit in order to maintain a desired set temperature in order to prevent heat illness or cold illness or to maximize athletic performance.

23. A protective system according to claim 18 wherein the temperature conditioning unit is configured to regulate a pressure of the fluid in the fluid bladder.

24. A protective system according to claim 18 wherein the temperature conditioning unit is configured to adjust a fluid pressure in the fluid bladder to a particular pressure in order to personalize a protection of the wearer based on a height, a weight, a concussive history, or other parameters of the wearer.

25. A protective system according to claim 1 further comprising a helmet.

26. A protective system according to claim 25 wherein the helmet comprises a head shell formed out of a light-weight composite and the helmet is devoid of padding, the head shell comprising a crown-to-frontal wedge bossing.

27. A protective system according to claim 25 wherein the helmet comprises a built-in soft gel eye socket mask.

28. A protective system according to claim 25 wherein the helmet comprises an adjustable face shield for protecting a face of the wearer and an adjustable chin protection for selectively covering the face of the wearer.

29. A protective system according to claim 28 wherein the face shield comprises wedge bossing.

30. A protective system according to claim 25 wherein the helmet comprises an alert indicator.

31. A protective system comprising:

a protective suit capable of withstanding a force of an impact during an athletic competition without tearing, the protective suit comprising:

a head portion comprising a fluid-filled head portion chamber;

a neck portion secured to the head portion and comprising a fluid-filled neck portion chamber, wherein the fluid-filled head portion chamber is in fluid communication with the fluid-filled neck portion chamber; and a torso portion secured to the neck portion and comprising a fluid-filled torso portion chamber, wherein the fluid-filled torso portion chamber is in fluid communication with the fluid-filled neck portion chamber;

wherein the fluid-filled neck portion chamber comprises a left neck portion chamber, a posterior neck portion chamber and a right neck portion chamber, and further wherein the left neck portion chamber, the posterior neck portion chamber and the right neck portion chamber are in fluid communication with one another; and further wherein, when the protective suit is worn by a wearer so that the head portion is disposed on a head of the wearer, the neck portion is disposed on a neck of the wearer, and the torso portion is disposed on a torso of the wearer, the neck portion chamber extends in an arcuate manner about the neck of the wearer, with the left neck portion chamber substantially covering a left side of the neck of the wearer, the posterior neck portion chamber substantially covering a posterior side of the neck of the wearer, and the right neck portion chamber substantially covering a right side of the neck of the wearer, such that when a force of an impact is received on the head portion, fluid from the fluid-filled head portion chamber is transferred into the neck portion chamber to support the neck of the wearer against translational and rotational forces imparted to the wearer, and when a force of an impact is received on the torso portion, fluid from the fluid-filled torso portion chamber is transferred to the neck portion chamber to support the neck of the wearer against translational and rotational forces imparted to the wearer.

32. A protective system according to claim 31 wherein the torso portion comprises:

a shoulder portion;

a front portion; and a back portion.

33. A protective system according to claim 31 wherein the neck portion chamber is configured so as to support the neck of the wearer against translational and rotational forces.

34. A protective system according to claim 31 wherein the fluid comprises a liquid.

35. A protective system according to claim 31 wherein the fluid comprises a gas.

36. A protective system according to claim 31 wherein the fluid-filled neck portion chamber is formed by an outer wall and an inner wall.

37. A protective system according to claim 31 further comprising an alert indicator for indicating when a force of an impact on the fluid-filled head portion chamber, the fluid-filled neck portion chamber, or the fluid-filled torso portion chamber exceeds a predetermined threshold.

38. A protective system according to claim 31 further comprising a temperature conditioning unit for temperature conditioning the protective suit.

39. A protective system according to claim 31 further comprising a helmet.

* * * * *